US005763805A

United States Patent [19]

Yamabata et al.

[11] Patent Number: 5,763,805

[45] Date of Patent: Jun. 9, 1998

[54] PERFORMANCE INFORMATION TRANSMITTER AND/OR RECEIVER FOR A PERFORMANCE INFORMATION SYSTEM

[75] Inventors: Toshio Yamabata; Minoru Fujisawa, both of Hamamatsu, Japan

[73] Assignee: Roland Corporation, Osaka, Japan

[21] Appl. No.: 481,142

[22] Filed: Jun. 7, 1995

Related U.S. Application Data

[63] Continuation of Ser. No. 645,508, Jan. 24, 1991, abandoned.

[30] Foreign Application Priority Data

Jan. 25, 1990 [JP] Japan ..... 2-16504
Jan. 31, 1990 [JP] Japan ..... 2-22829
Aug. 30, 1990 [JP] Japan ..... 2-230941

[51] Int. Cl.[6] ..... C10H 5/00; C10H 7/00; C10H 8/00

[52] U.S. Cl. ..... 84/645; 84/627; 84/462

[58] Field of Search ..... 84/462, 645, 171, 84/627; 369/47; 360/48, 32

[56] References Cited

U.S. PATENT DOCUMENTS 4,099,437 7/1978 Skavrou et al. ..... 84/462 X
5,074,185 12/1991 Nishikawa et al. ..... 84/627

*Primary Examiner*—William M. Shoop, Jr.
*Assistant Examiner*—Marlon T. Fletcher

[57] ABSTRACT

A performance information transmission system includes a performance information transmitter device and a performance information receiver device which are capable of correcting transmission errors in event information transmitted from the performance information transmitter device to the performance information receiver through a wire or radio communication. This correction does not require another transmission passes, cause a delay of the generation of the musical tone, or cause difficulties in restoring the burst error. The performance information transmitter device is equipped with state information generating device which generates state information for indicating the control state of a musical tone of a predetermined musical tone after a change has occurred in the event information. A transmit device transmits sequentially the event information and the state information generated by the state information generating device. Further, the performance information receiver device is equipped with a receiver for receiving sequentially an event information which causes a change in a predetermined musical tone and the state information indicating the control state of a musical tone of the predetermined musical tone. An event information correction device corrects the transmission error of the event information received by the receiver based on the state information received in the same manner.

12 Claims, 26 Drawing Sheets

| MIDI channel No. | Note No. | Note-on flag | Velocity |
|---|---|---|---|
| 0 | 0 | | |
| 0 | 1 | | |
| 0 | 2 | | |
| ≈ | ≈ | ≈ | ≈ |
| 0 | 126 | | |
| 0 | 127 | | |
| 1 | 0 | | |
| 1 | 1 | | |
| ≈ | ≈ | ≈ | ≈ |
| 1 | 127 | | |
| 2 | 0 | | |
| ≈ | ≈ | ≈ | ≈ |
| 15 | 126 | | |
| 15 | 127 | | |

FIG. 3

| Name of byte | Type of byte |
|---|---|
| F0H | Exclusive status |
| MAN | Manufacture ID |
| DEV | Device ID |
| MDL | Model ID |
| CMD | Command ID |
| [BODY]<br>:<br>: | Data body ( State data )<br>:<br>: |
| F7H | End of system exclusive |

FIG.12

PERFORMANCE INFORMATION TRANSMITTER AND/OR RECEIVER FOR A PERFORMANCE INFORMATION SYSTEM

This application is a continuation, of application Ser. No. 07/645,508 filed on Jan. 24, 1991, now abandoned.

BACKGROUND OF THE INVENTION

1. Field of the Invention

This invention relates to a performance information transmission system and more particularly, a performance information system comprising a performance information transmitter device and a performance information receiver device and to the technique of correcting the transmission error of performance information, which is transmitted from the performance information transmitter device to the performance information receiver device through a wire or a radio communication, in other words, event information.

2. Description of Related Art

The transmission of performance information from one electric musical instrument to another electric musical instrument, for example, is executed in accordance with the MIDI standard. Included in the performance information transmitted by this MIDI standard is, for example, event information which causes the changes of a predetermined musical tone based on a key or a switch operation. Note-on and note-off information of key-on/off information, which is a kind of this event information is transmitted only at the time of each key-on/off.

In the prior art, the transmission error have not dealt with a substantial error correction technique but with a simple initializing amendment function, such as all note-off or active sensing, etc.

SUMMARY OF THE INVENTION

Normally, the transmission error seldom occurs, so it does not imposes a problem, however, on a wire communication of a long distance or a radio communication using waves or infrared rays, such an error occurs. This problem of transmission error, for example, causes the failure to receive the event information on the key-on/off information, and as a result the musical tones corresponding to the pressing of the keys are not generated and even after the key-off, the musical tones continues to be generated.

In order to cope with this problem, one possible solution is to perform an error correction by retransmitting when an error transmission occurs. However, in this case, the problem is that it requires a transmission passage of re-transfer demand signal from a receiving side to a transmitting side. Among other solutions are an adoption of error correction technique or repeating the transmissions of the same data several times. However, in this case, the problem is that if a burst error (data which are missing for a certain period) is caused by the external noise, restoration is difficult.

Accordingly, in view of the aforementioned problems, in correcting transmission errors, it is an object of the present invention to provide the performance information transmitter device and the performance information receiver device in the performance information transmission system, which is convenient since it does not require an another transmission passage and which is capable correcting burst errors.

In order to accomplish this object, the performance information transmitter device in the performance information transmission system has characteristics as shown in FIG. 1 and comprises:

(a) a state information generating device (1) for generating state information which indicates the control state of a musical tone of a predetermined musical tone after a change occurs in event information which causes the change in the predetermined musical tone; and (b) a transfer device (2) for transmitting sequentially the event information and the state information generated by the above-mentioned state information generating means (1).

The state information generating device (1) may perform the generation of the state information of the predetermined musical tone by renewing the state information for the predetermined musical tone in a memory map by means of the event information.

Further, the performance information receiver device in the performance information transmission system has a characteristics as shown in FIG. 1 and comprises:

(a) a receiving device (11) for receiving sequentially event information which causes a change in a predetermined musical tone and state information which indicates the control state of a musical tone of the predetermined musical tone after the change occurs in the event information; and (b) an event information correction device (12) for correcting the transmission error of the event information received by the receiving device (11) based on the state information which is received in a same manner;

The event information correction (12) may correct the transmission error of the event information for the predetermined musical tone by amending the contents which are updated by the event information for the predetermined musical tone in a memory map by means of the state information.

Since the event information, which is performance information, is corrected by the state information which is also performance information, a correction can only be done only through the transmission passage of performance information from a transmitting side to a receiving side or, since an another transmission passage for such as retransmission demand signal from the receiving side to the transmission side is not necessary, the correction can be done easily.

Further, since the event information is corrected by the state information, an error correction of the event information can be done without difficulties in restoring, that is, correcting the burst error.

When the note-on number indicating the number of note-on at the present time is included in the state information, the state information generation device (4) may perform the generation of the state information which includes the note-on number of the predetermined musical tone by updating the state information which includes the note-on number of the predetermined musical tone in the memory map by the event information. Also, the event information correction device (12) may perform the correction of the transmission error of the event information for the predetermined musical tone by amending the contents, which includes the note-on number to be updated by the event information for the predetermined musical tone in the memory map by means of state information including note-on number.

Further, the performance information transmission system comprises a performance information transmission device and a performance information receiver device.

Other object of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWING

The present invention will become more fully understood from the detailed description given hereinbelow and the accompanying drawings which are given by way of illustration only, and thus are not limitative of present invention, and wherein:

FIG. 2 to FIG. 22 are drawings for explaining a first embodiment of a performance information transmitter device and a performance information receiver device in a performance information transmission system in accordance with the invention, FIG. 2 is a schematic block diagram;

FIG. 3 is a structural diagram of a note map to be memorized in a RAM on the performance information transmitter device and the performance information receiver device, respectively;

FIG. 4 to FIG. 11 are flow-charts of a main routine, a MIDI IN process routine, a state information process routine, a MIDI In interrupt process routine, a transmit interrupt process routine, a status byte process routine, a note-on/off process routine and a channel mode process routine on the performance information transmitter device, respectively;

FIG. 12 is a format diagram of a state information;

FIG. 13 to FIG. 22 are flow-charts of a main routine, a status byte receiver process routine, a receiver error process routine, a state information receiver process routine, a note-on/off receiver process routine, a channel mode receiver process routine, a receiver interrupt process routine, a MIDI OUT interrupt process routine, a state renewal process routine and a note on/off amendment process routine of performance information receiver device, respectively;

DETAILED DESCRIPTION OF PREFERRED EMBODIMENTS

Figure 1:
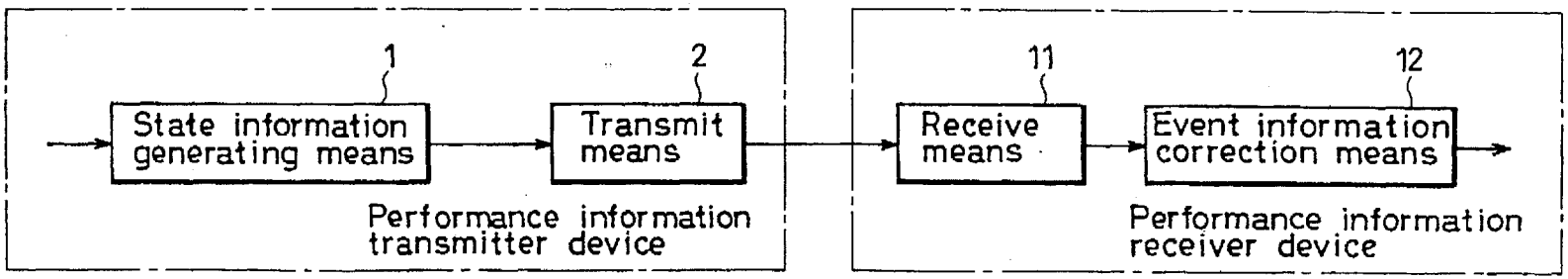
FIG. 1 is a block diagram corresponding to a constitution of the invention as described in the claims.

Preferred embodiments of a performance information transmitter device and a performance information receiver device which are incorporated in a performance information system will be described referring to the drawings.

Figure 2:
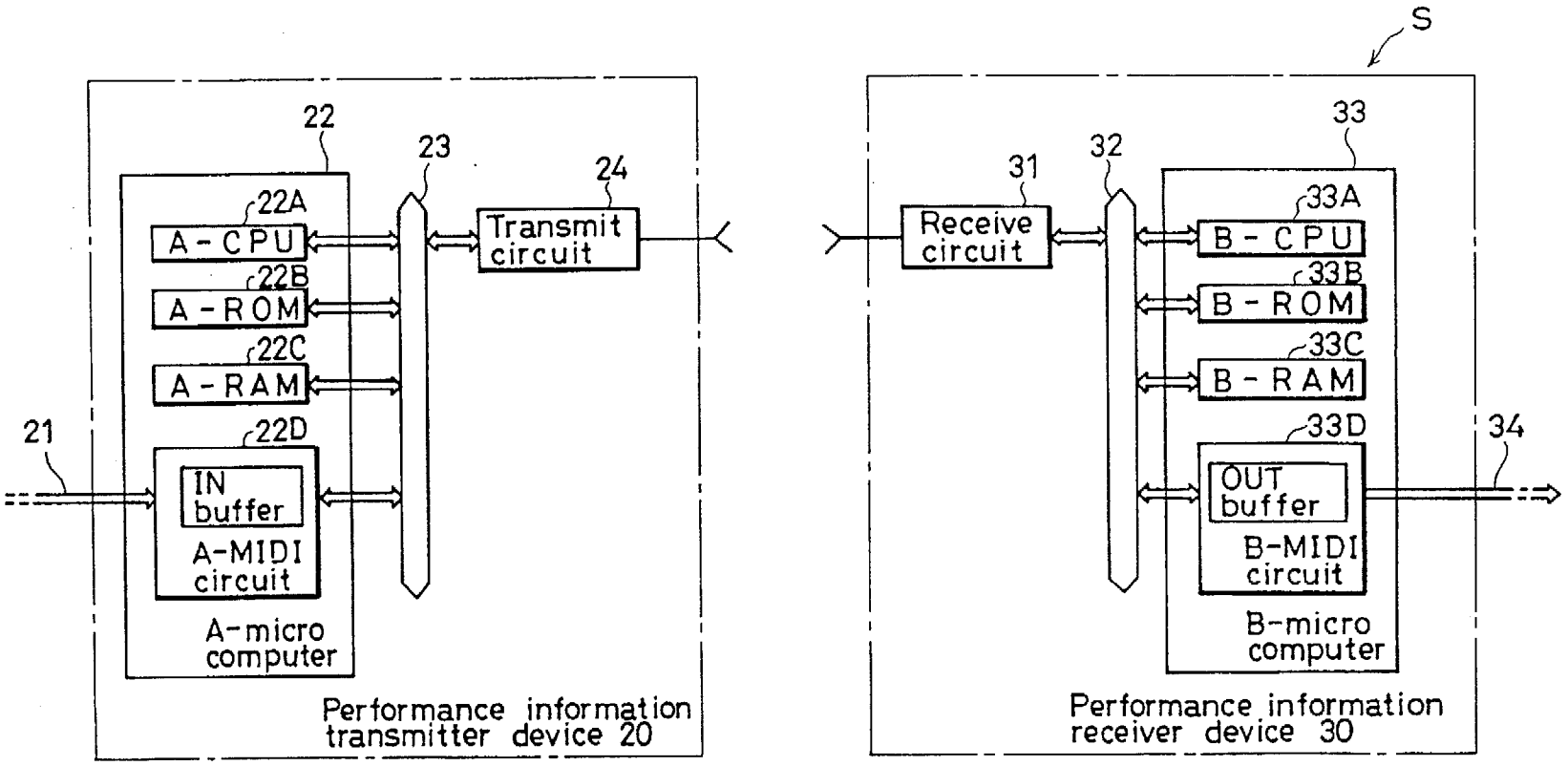

First Embodiment:

The performance information transmitter device and performance information receiver device in performance information transmission system, to which the invention may be applied is schematically shown in FIG. 2. As shown in it, the performance information transmission system S, comprising a performance information transmitter device 20 and a performance information receiver device 30, transmits MIDI messages defined by MIDI specification from the performance information transmitter device 20 and state information inserted in the empty time of the MIDI message. These MIDI message and state information are received at the performance information receiver device 30 through a radio communication passage. Included in the MIDI messages are event information which causes the change in a predetermined musical tone such as key-on or key-off information. And the state informations indicates the state of the musical tone control for a predetermined musical tone after the change caused by the key-on/-off information, which are made in the performance information transmitter device 20 based on the key-on/-off information included in the MIDI messages, and in other the state information words indicates the musical tone control state represented by a note-on flag and a velocity.

In the performance information transmitter device 20, the MIDI message including the key-on/-off information from a keyboard device and a sequencer (not shown in the drawings) or the like are inputted to a A-micro computer 22 through a MIDI bus 21. This A-micro computer 22 comprises a A-central processing unit (CPU) 22A which executes predetermined programs, a A-read only memory (ROM) 22B which stores the programs, a A-random access memory (RAM) 22C used as a work area or the like for defining various registers, FIFOs, maps or the like required for executing the programs and a A-MIDI circuit 22D having a IN buffer of a first-in and first-out style. The afore-mentioned MIDI messages including key-on/-off information are inputted to and accumulated in the IN buffer of the A-MIDI circuit 22D. Based on this accumulation, the A-MIDI circuit 22D requests a MIDI IN interruption to the A-CPU 22A through a MIDI bus 23. By executing the predetermined programs stored in the A-ROM 22B, based on the MIDI messages accumulated in the IN buffer, the A-micro computer 22 inserts the contents of a A-note map, which is defined in the A-RAM 22C, stored and updated by the key-on/-off informations included in the MIDI messages at the empty time of MIDI messages as the state informations, transfers the state information together with the MIDI messages to the transmitter circuit 24 equipped with a transmit buffer of a first-in and first-out style via the A-MIDI bus 23, and causes the transmitter circuit 24 to transmit the date. As shown on FIG. 3, this A-note map consists of 1) MIDI channel Nos. from 0 to 15, 2) note Nos. from 0 to 127 for each MIDI channel No., as address, 3) note-on flags showing the key-on/-off states, and 4) the velocities showing the touch of key in time of key-on in the key-on state and in time of key-off in the key-off state which are stored and updated by the key-on/-off information, corresponding to the MIDI channel Nos. and note Nos. The content of the MIDI channel Nos., note Nos., note-on flags, and velocities, are transferred to the transmitter circuit 24 as state information.

In case when there is a demand to send from the A-micro computer 22 and a new transmit is possible as the previous one is finished, the transmitter circuit 24 requests a transmit interruption to the A-micro computer 22 through the A-MIDI bus 23 and reads out one byte of a MIDI message or state information accumulated in the transmit buffer in time sequence. A carrier wave signal modulated with the transmit data is transmitted as an electric wave through a transmission antenna. The afore-mentioned transmit data consist of 11 bits having a start bit "0", one byte of a MIDI message or state information read out from the transmit buffer as a data body, a parity bit and a stop bit "1", in sequence. Further, the parity bit is arranged in a manner that when the parity but is 0, the sum of the parity bit and each bit of the data body becomes "0."

In the performance information receiver device 30, the electric wave received from the radio communication passage through a receive antenna is inputted to the receiver circuit 31 equipped with the receiver buffer. This receiver circuit 31 takes out the transmit data by demodulating the electric wave of modulated transmit carrier wave signal inputted corresponding to the modulation system of transmitter circuit 24 and accumulates the parity data for a parity check, the MIDI message or state information as the first byte and second byte respectively in the receiving buffer. The receiver circuit it requests a receive interruption from a B-micro computer 33 through a B-bus 32. In the parity check, the parity data are set as "00H" when the bit is 0 and the sum of each bit from bit 0 to bit 9 is "0," indicating normal reception, and set as "01H" when the bit is 0 and the sum of each bit is "1," indicating a transmit error.

The B-micro computer 33 comprises, same as the A-micro computer 22, a B-central Processing Unit (CPU) 33A which executes predetermined programs, a B-read only Memory (ROM) 33B which stores the programs, a B-random access memory (RAM) 33C used as a work area or the like for defining various FIFOS registers, maps or the like required for executing the programs, and a B-MIDI circuit 33D having the OUT buffer of a first-in and first-out type which outputted the data to a MIDI bus 34 as MIDI messages or the like. By executing the predetermined programs stored in the B-ROM 33B in advance based on the parity data, MIDI messages, and state information accumulated in the receive buffer of the receiver circuit 31, the B-micro computer 33 outputted from the OUT buffer of the B-MIDI circuit 33D to the MIDI bus 34 the MIDI messages and the MIDI messages for amendment which are amended by the state information in the B-note map which is defined in the B-RAM 33C to be stored and updated by the key-on/off information included in the MIDI messages and amended by the state information. This B-note map consists of MIDI channel Nos. and note Nos. as address as shown in FIG. 3, and note-on flags and velocities, which are stored and updated by the key-on/-off information, same as the A-note map. Musical tone is generated from the music generating device or the like (not shown on the drawings), which is connected to the MIDI bus 34, based on the MIDI massages and the MIDI messages for amendment to be outputted to the MIDI bus 34.

Next, before referring to the function of the aforementioned performance information transmitter device 20, description is given about a IN FIFO, a Transmit-FIFO and a Real-time FIFO in the working area which are defined in the A-RAM 22C.

IN FIFO

A first-in/first-out memory (FIFO) to be used for storing the MIDI message except for the system real time message read out by the IN buffer of the A-MIDI circuit 22D.

Transfer FIFO

A first-in/first- out memory (FIFO) to be used for transferring the MIDI messages except for the system real time message.

Real Time Transfer FIFO

A first-in/ first-out Memory (FIFO) to be used for transferring the system real time message.

IN Auxiliary FIFO

A first-in/first out Memory (FIFO) to be used for storing temporarily the MIDI messages except for the system real time message to be entered in In FIFO.

These In FIFO, Transfer FIFO, Real Time Transfer FIFO and IN auxiliary FIFO which are supposedly constructed in a ring form perform the writing in and reading out of the addresses indicated by a writing pointer and a reading pointer respectively and for every writing in and reading out each pointer is advanced.

No special description is given on various registers which store each variable, table, buffer, flag, pointer 10 or the like, but they are presumed to be assigned at the predetermined area of the A-RAM 22C.

Figure 4:
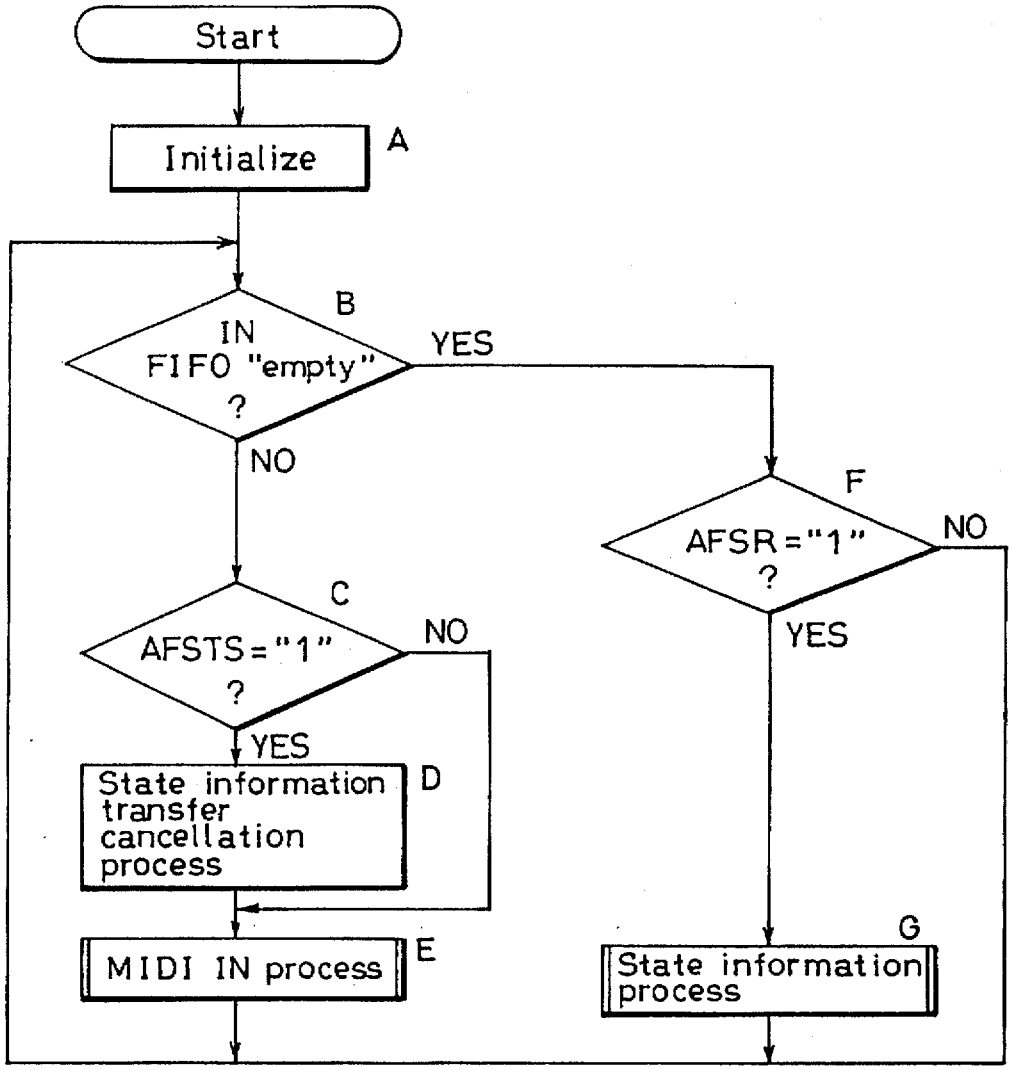

Next, the basic function of the performance information transmitter device 20 is described as follows according to the flow chart of a main routine on transmission as shown in FIG. 4.

A. Power supply is turned on in order to start up execution of the predetermined programs and the contents of A-RAM 22C are initialized by which the contents of various registers and all FIFOs, defined in A-RAM 22C are cleared and concerning all note Nos. of all MIDI channels on the A-note map, the note-on flags are set "1" and the velocities are set as "10". Further the IN buffer of A-MIDI circuit 22D and the transmit buffer of the transmitter circuit 24 are cleared and initialized. The state of "1" of the note flag and "0" of the velocity is equal to the state of "0" of the note-on flag and "64" of the velocity, indicating the note off.

B. A decision is made as to whether the In FIFO is "empty" or not. In case of "empty," go to the step F.

C. On the decision in step B, in case that In FIFO is not "empty," a decision is made as to whether a state information transfer processing flag AFSTS is "1" indicating a state information transfer process is under way, or not. In case of not "1," it indicates that the state information transfer process is not under way, go to the step E.

D. On the decision in Step C, in case that the state information transfer processing flag AFSTS is "1" indicating the state information transfer is under way, enter the "F7H," indicating the end of the transfer in the Transfer FIFO, and cancel the transfer of state information before the processing of a new MIDI message by generating a transmit instruction for the transmitter circuit 24. Also, the state information transfer processing flag AFSTS is set as "0" indicating the transfer process is over. The reason for it is that even if the MIDI message, except for the system real time message, is transferred while the state information is being transferred, it can not be decoded at the receiver side. Therefore, the transfer is canceled in order to enable the transfer of new MIDI message.

Further, a state note No. ASRK indicating the note No,. which is an object of state information process is replaced with a reopened state note No. ASBK which indicates the note No. which is an object of the state information process in time of the reopening of transfer, so that the next one in the note No. can be transferred when the transfer is reopened.

E. A MIDI IN process routine. Execute the transfer process of the MIDI message entered in the IN FIFO, and update the A-note map. Detail will be described later according to the flow chart shown in the FIG. 5. After the MIDI IN process, return to step B.

F. On the decision in step B, in case that the IN FIFO is "empty", a decision is made as to whether a Transfer FIFO empty flag AFSR is "1" indicating both the Transfer FIFO and Real Time Transfer FIFO are empty or not. When state information is remaining in the Transfer FIFO, the transfer of a new MIDI message in step E is delayed. This is why state information is entered in the Transfer FIFO only when both of the Transfer FIFO and Real Time Transfer FIFO are "empty." In case of not "1" indicating both the Transfer FIFO and real time Transfer FIFO are not "empty," return to step B, and go to step G in case of "1."

G. A state information process routine. The state information is transmitted by checking the A-note map.

Details will be described later according to the flow chart shown in the FIG. 6. After the state information process, return to step B.

In brief, based on the MIDI message inputted from the MIDI bus 21, the storing and updating processes of A-note map and the transferring processes of MIDI messages to the transmitter circuit 24 are executed. The state of A-note map is transmitted to the transmitter circuit 24 sequentially as state information.

Before referring to the each sub routine of MIDI IN process routine (Step E) and state information process routine (Step G), description is given on each interrupt process routine of MIDI IN interrupt process routine and transmit interrupt routine.

Figure 7:
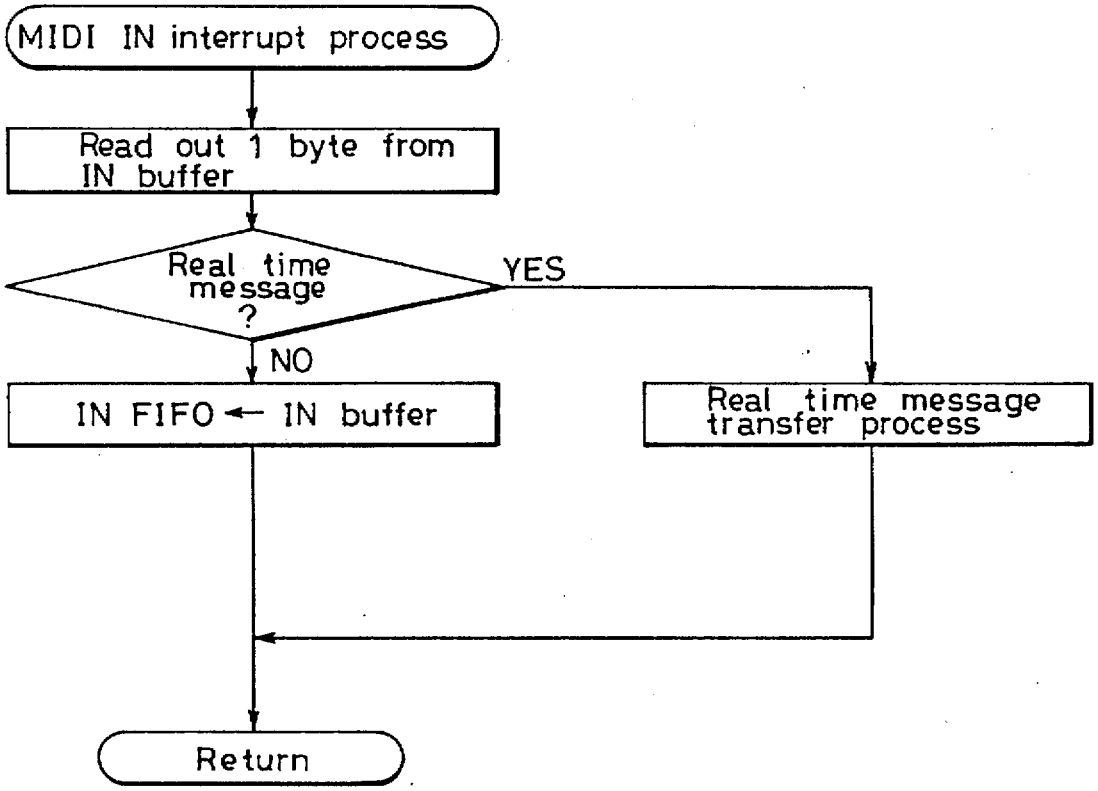

MIDI IN interrupt process routine (FIG. 7)

A MIDI IN interruption is requested when 1 byte of a MIDI message is accumulated in the IN buffer of the A-MIDI circuit 22D through the MIDI bus 21, and following process is executed.

When the MIDI message, which is accumulated in the IN buffer and read out from it, is not a system real time message, the read-out MIDI message is entered in the IN FIFO. That is, the MIDI message which is not a system real time message inputted through the MIDI bus 21 is entered temporarily in the IN Auxiliary FIFO. In this way, a decision is made as to whether all the bytes of the MIDI message were inputted or not. When all the bytes have been inputted, each byte is passed through the IN auxiliary FIFO in sequence and entered in the IN FIFO and the routine is finished. On the other hand, in case that not all of the bytes are inputted, the routine is over without executing a special process. Further, if a status byte except for the new system real time message is inputted or the predetermined number of bytes corresponding to the message type of MIDI message is inputted, all the bytes are regarded as having been inputted. In case that the MIDI message to be entered in the IN FIFO is a running status, the regulating relationship for the running status is released and a status byte is added to it so that it can be handled as an individual independent MIDI message. (Refer to the MIDI 1.0 specification Document Version. 4.1) In this case, every time each independent MIDI message is made, it is entered in the IN FIFO in sequence.

Also, when the read-out MIDI message is a system real time message, it is entered in the Real Time Transfer FIFO in a same manner. Next, the Transfer FIFO empty flag AFSR is set as "0" indicating the Transfer FIFO or Real Time Transfer FIFO is not "empty" and a real time message transfer procedure is executed by giving a demand to send to the transmitter circuit 24.

In brief, in the MIDI IN interruption processing routine, a transfer processing is executed in case of the MIDI message input through the MIDI bus 21 being equal to the system real time message, and in case of not being the system real time message, it is entered in the IN FIFO.

Figure 8:
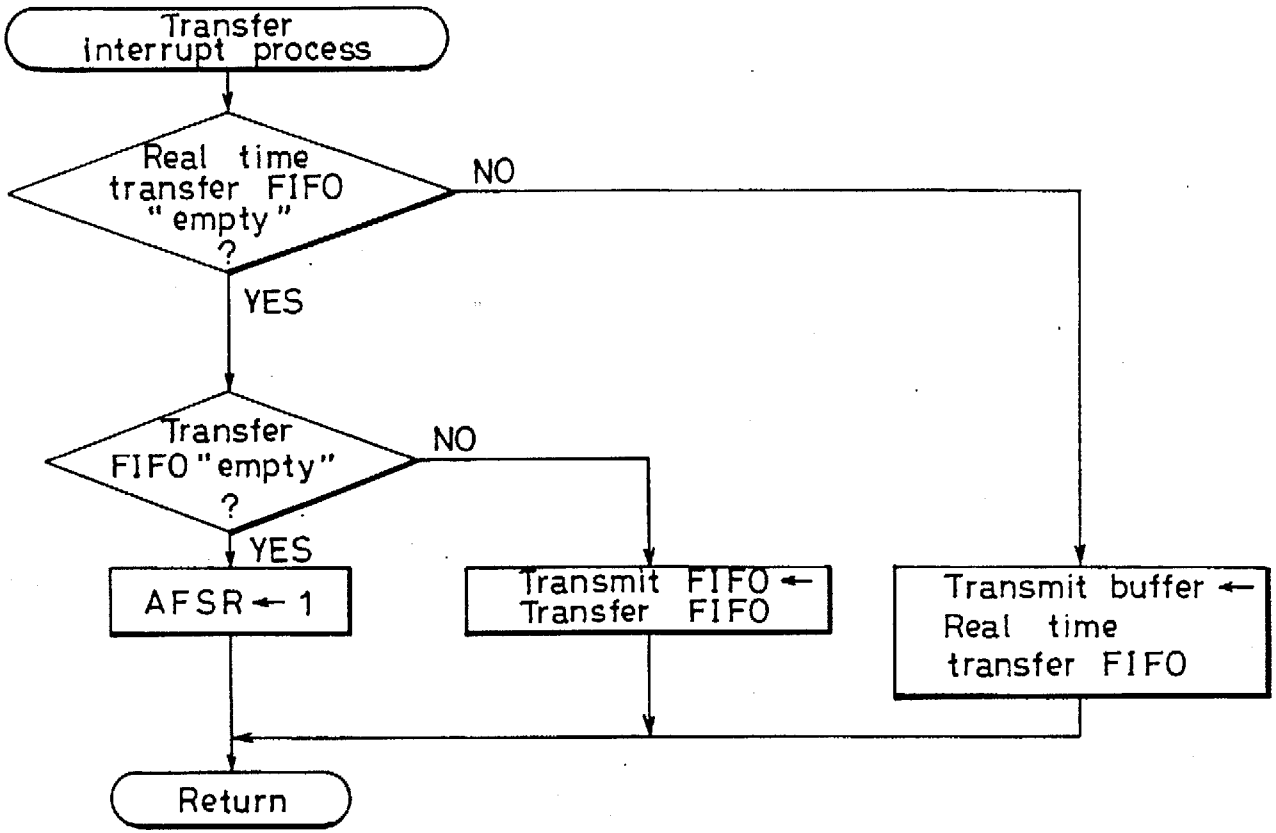

Transfer interruption processing routine (FIG. 8)

A Transfer interruption is requested when a new transmit is possible as the transmitter circuit 24 finished the previous transmit based on the demand to send and the following process is executed.

First, when a MIDI message remains in the Real Time Transfer FIFO, 1 byte of the MIDI message is read out from this Real Time Transfer FIFO and the readout MIDI message is accumulated in the transfer buffer of the transmitter circuit 24. Next, when a MIDI message does not remain in the Real Time Transfer FIFO but remains in the Transfer FIFO, 1 byte of the MIDI message is read out from this Transfer FIFO and this read-out MIDI message is accumulated in the transmit buffer of the transmitter circuit 24 in a same manner as afore mentioned above.

When a MIDI message does not remain in neither of the Transfer FIFO or Real Time Transfer FIFO, the Transfer FIFO empty flag AFSR is set as "1" indicating both of the Transfer FIFO and Real Time Transfer FIFO are "empty" and the demand to send to the transmitter circuit 24 is canceled.

In brief, in the transfer interruption processing routine, the system real time message of MIDI message remaining in the Real Time Transfer FIFO is accumulated in the transmit buffer of the transmitter circuit 24 on placing priority before others, the transfer FIFO empty flag AFSR is set as "1" when the MIDI message to be sent is running out and thereby the demand to send to the transmitter circuit 24 is canceled.

Figure 5:
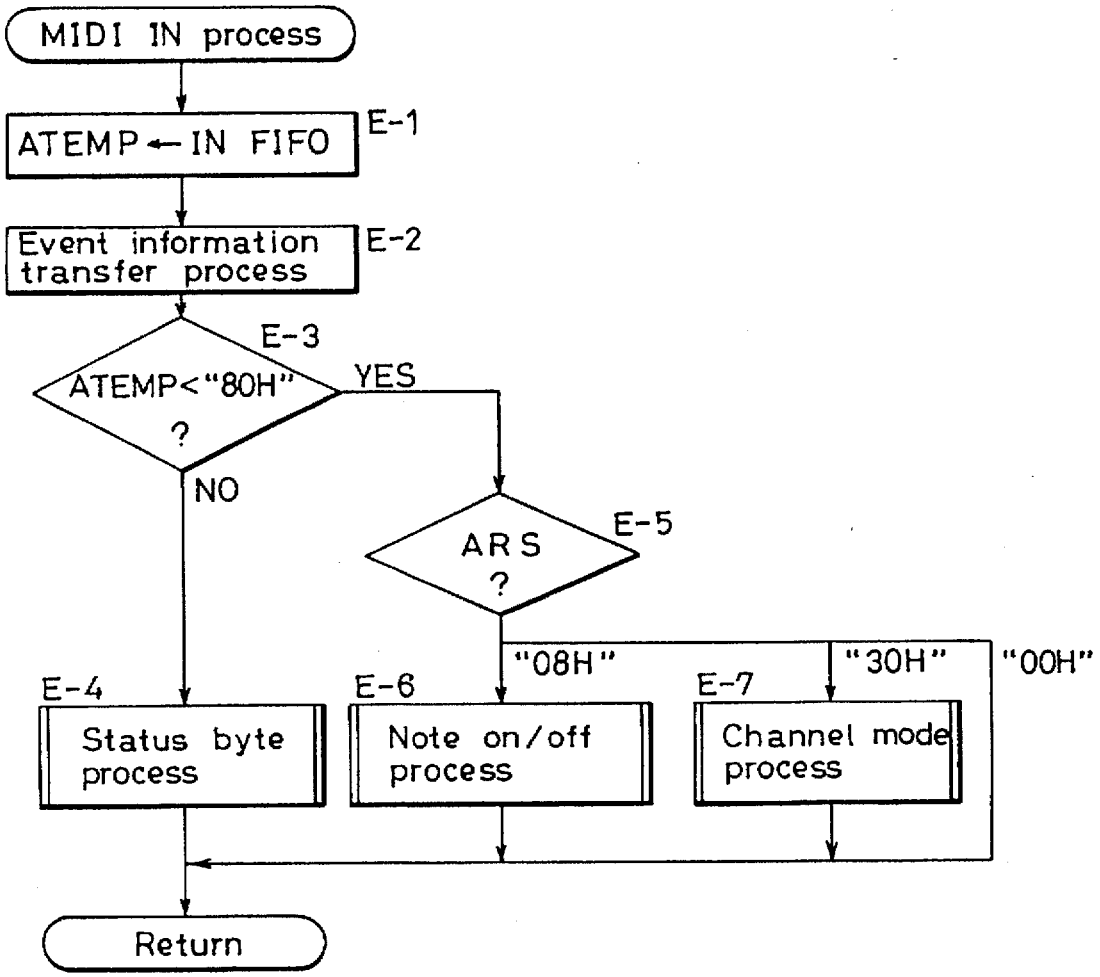

Next, description is given about the MIDI IN processing routine (Step E) referring to the FIG. 5.

E-1. Read out 1 byte of the MIDI message from the IN FIFO and replace the temporary data ATEMP which is transient data in the course of processing with this readout message.

E-2. By entering the temporary data ATEMP in the Transfer FIFO, setting the Transfer FIFO empty flag AFSR as "0" indicating the Transfer FIFO or Real Time Transfer FIFO is not "empty", and by giving a demand for send to the transfer circuit 24, an event information transfer process is executed. In this way, the MIDI messages including the event information are transmitted by the transmitter circuit 24.

E-3. A decision is made as to whether the temporary data ATEMP is less than "80H" or not. In case of less than "80H," go to the step E-5 and not less than 80H, go to the next step E-4.

E-4. A status byte processing routine. In case that the temporary data ATEMP is not less than "80H", since the temporary data ATEMP is a status byte, this temporary data ATEMP is decoded and a status byte processing is executed, such as setting the message code ARS indicating the message type of this MIDI message for decoding a data byte to be followed. Details will be described later referring to the flow chart shown on FIG. 9. After the status byte processing, return to the main routine.

E-5. On the decision in step E-3, in case that the temporary data ATEMP is decided to be less than "80H", since this temporary data ATEMP is a data byte, a decision is made as to whether a message code ARS is "00H". "08H" or "30H". In case of "00H", return to the main routine, since the temporary data ATEMP is a data byte of MIDI message corresponding to neither note-on, note-off or channel mode. In case of "08H", proceed to step E-6, In case of "30H, go to step E-7.

E-6. A note-on/off process routine. In case that the message code ARS is "08H," since the temporary data ATEMP is the data byte corresponding to the note-on or note-off, a note-on and note-off process of updating and storing the A-note map is executed. Details will be described later referring to the flow chart shown on FIG. 10. After the note-on and note-off process, return to the main routine.

E-7. A channel mode process routine. In case that the message code ARS is "30H", there is a possibility of the temporary data ATEMP being the data byte corresponding to the all note-off included in the channel mode. Therefore, a channel mode process is executed and in case of all note-off, the A-note map is stored or updated. Details will be described later based on the flow chart shown in the FIG. 11. After the channel mode process, return to the main routine.

In brief, in the MIDI IN process routine (Step E), the transfer process of the MIDI messages including the event informations which is entered in IN FIFO is executed and the A-note map is updated and stored.

Next, description is given on each process routine of status byte process routine (Step E-4), note on/off process routine (Step E-6) and channel mode process routine (Step E-7).

Figure 9:
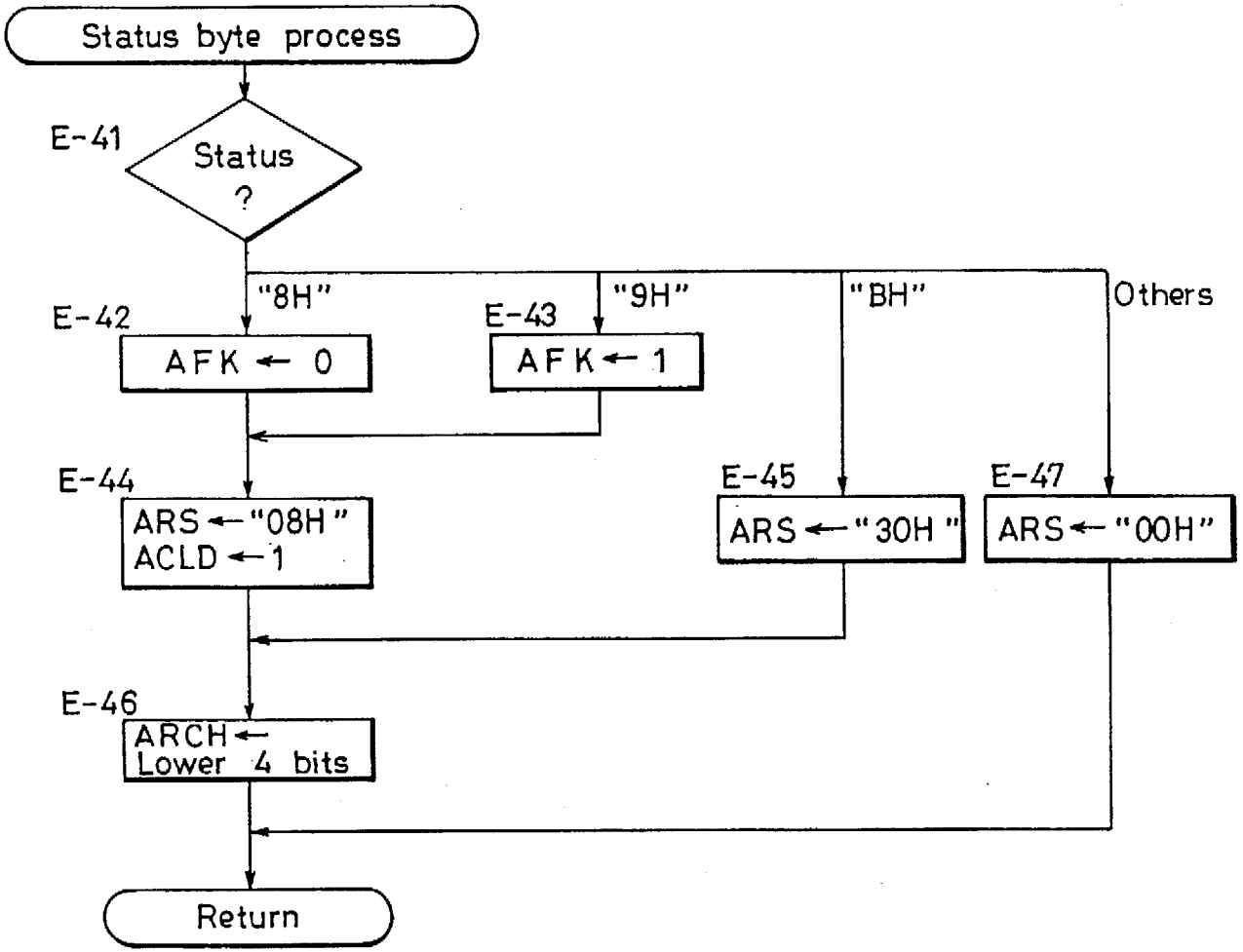

Status byte process routine (Step E-4) (FIG. 9)

E-41. The status of temporary data ATEMP is decided by which one of the "8H" "9H" "BH" or else is the upper four bits of the temporary data ATEMP. In case that this upper four bits is "8H", that is, a note-off status, go to the next step E-42. In case of "9H," that is, a note-on status go to the step E-43. In case of "BH," that is, a channel mode status, go to the step E-45. In case of neither of "8H," "9H," nor "BH," proceed to the step E-47.

E-42, E-43. On the decision in step E-41, in case that the upper four bits is decided to be "8H," since the status of the temporary data ATEMP is note-off, a note-on flag AFK is set as "0." In case of "9H", since the status of the temporary data ATEMP is note-on, the note-on flag AFK is set as "1".

E-44. Beside the message code ARS being set as "08H" indicating a note-on or note-off, a data byte step ACLD indicating the decoding step of the data byte of the temporary data ATEMP is set as "1."

E-45. On the decision in step E-41, in case that the upper four bites are decided to be "BH," as the status of the temporary data ATEMP is either channel mode or control change, the message code ARS is set as "30H," hinting the possibility of the channel mode.

E-46. A channel No. ARCH is replaced with the MIDI channel No. represented by the lower four bits of the temporary data ATEMP E-47. On the decision in step E-41, in case that the upper four bits are decided to be neither of "8H," "9H," nor "BH," the message code ARS is set as "00H" indicating that it is a MIDI message code which does not corresponds to the either of the note-on, note-off or channel mode.

In brief, in the status byte process routine (Step E-4), in case that one byte read out from the IN FIFO is a status, the decoding of data byte to be followed corresponding to the upper four bits which indicates the status is prepared and channel No. ARCH is replaced with the lower four bits indicating the MIDI channel No.

Figure 10:
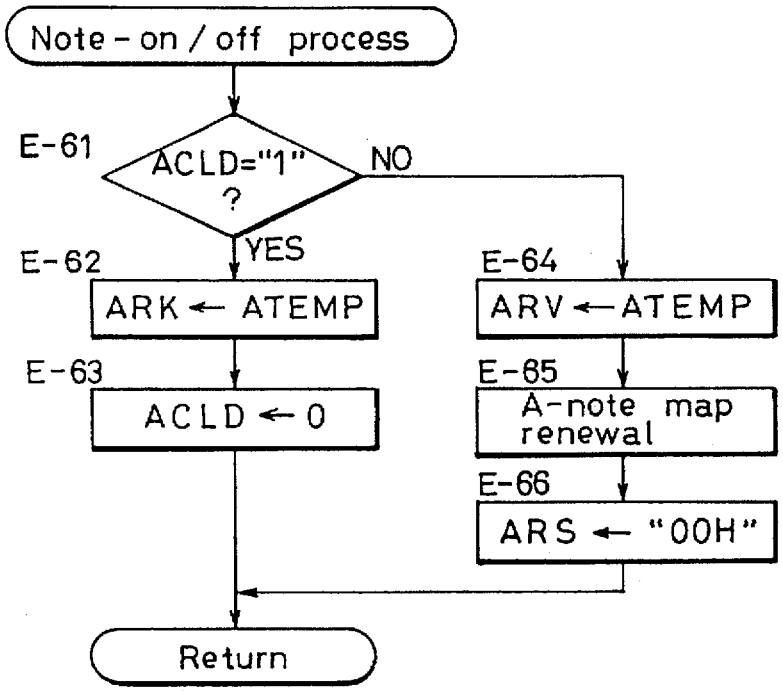

Note-on/off process routine (Step E-6) (FIG. 10)

E-61. A decision is made as to whether the data byte step ACLD indicating the decoding step of the data byte of the temporary data ATEMP is "1" or not. In case of not "1," go to step E-64.

E-62, E-63. On the decision in step E-61, in case that the data byte step ACLD is decided to be "1", since the temporary data ATEMP is a note No. data, note No. ARK is replaced with this temporary data ATEMP and the data byte ACLD is set as initial state of "0,"

E-64 to E-66. On the decision in step E-61, in case that the data byte step ACLD is decided to be "0", since the temporary data ATEMP is a velocity data, a velocity ARV is replaced with this temporary data ATEMP. Next, the note-on flag and velocity wherein the MIDI channel No. is the channel No. ARCH and the note No. is the note No. ARK in the A-note map, are updated with the content of the note-on flag AFK and velocity ARV and the message code ARS is set as "00H" indicating that it is a MIDI message which does not correspond either note-on, note-off or channel mode.

In brief, in the note-on/off process routine (Step E-6), since one byte following the status byte in the MIDI message represents note No. and the next one byte represents the velocity, the A-note map is stored or based on these note No. and velocity.

Figure 11:
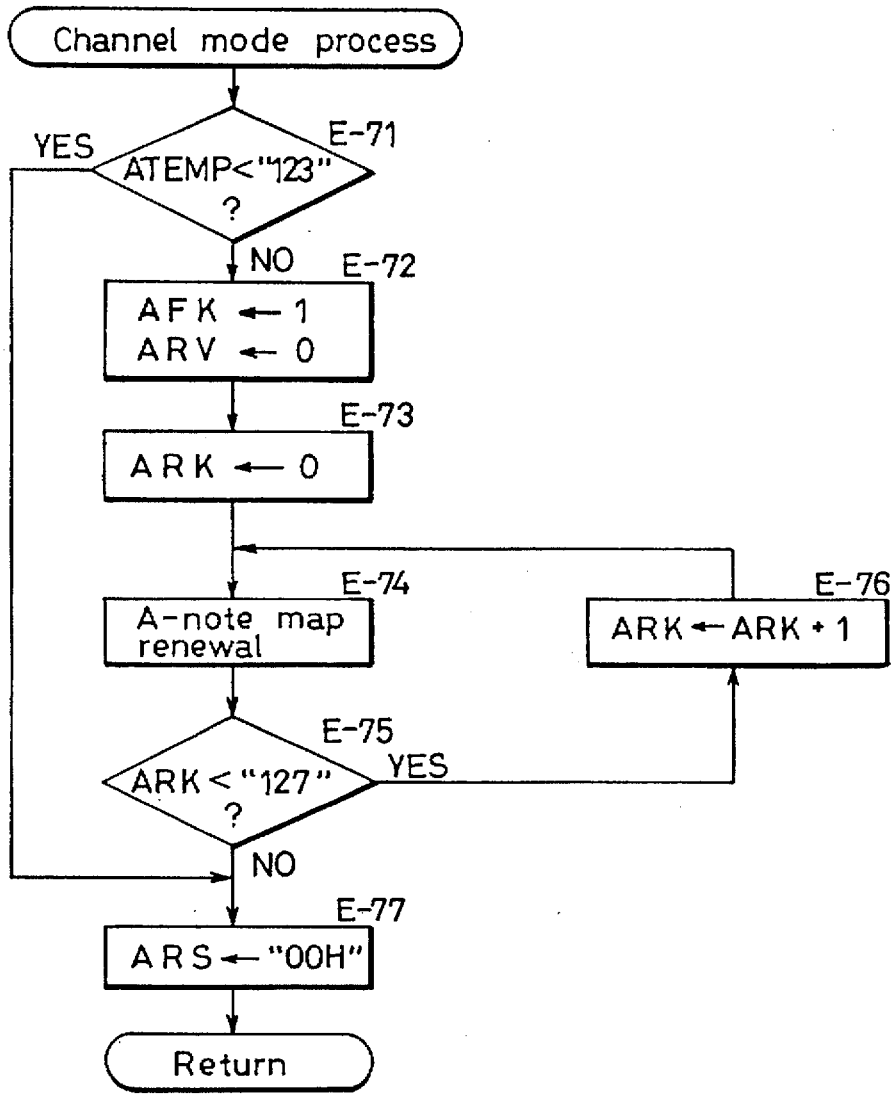

Channel mode process routine (Step E-7) (FIG. 11)

E-71. A decision is made as to whether the temporary data ATEMP is less than "123" or not. In case that this temporary data ATEMP is less than "123," go to Step E-77.

E-72, E-73. On the decision in step E-71, in case that the temporary data ATEMP is decided to be not less than "123," since the MIDI message is the one which requires all note off process, the note-on flag AFK is set as initial state of "1" and the velocity is set as initial state of "0", and the note No. ARK is set as "0".

E-74. Update the note-on flag and velocity wherein the MIDI channel No. is the channel No. ARCH and the note No. is the note No. ARK in the A-note map with the contents of note-on flag AFK and velocity ARV.

E-75, E-76. A decision is made as to whether the note No. ARK is less than "127" or not. In case that this note No. is less than "127," add "1" to the note No. ARK and return to the step E-74.

E-77. On the decision in step E-75, in case that the note No. ARK is decided to be not less than "127," since all note off processes are finished, the message code ARS is set as "00H" indicating that the temporary data ATEMP is the MIDI message corresponding neither note-on, note-off nor channel mode.

In brief, in channel mode routine (Step E-7), in case that the received MIDI message is all note off, all note off process is done, that is, the note-on flag and velocity of all the note Nos. wherein the MIDI channel No. in the A-note map corresponds to the channel No. ARCH are initialized.

Figure 6:
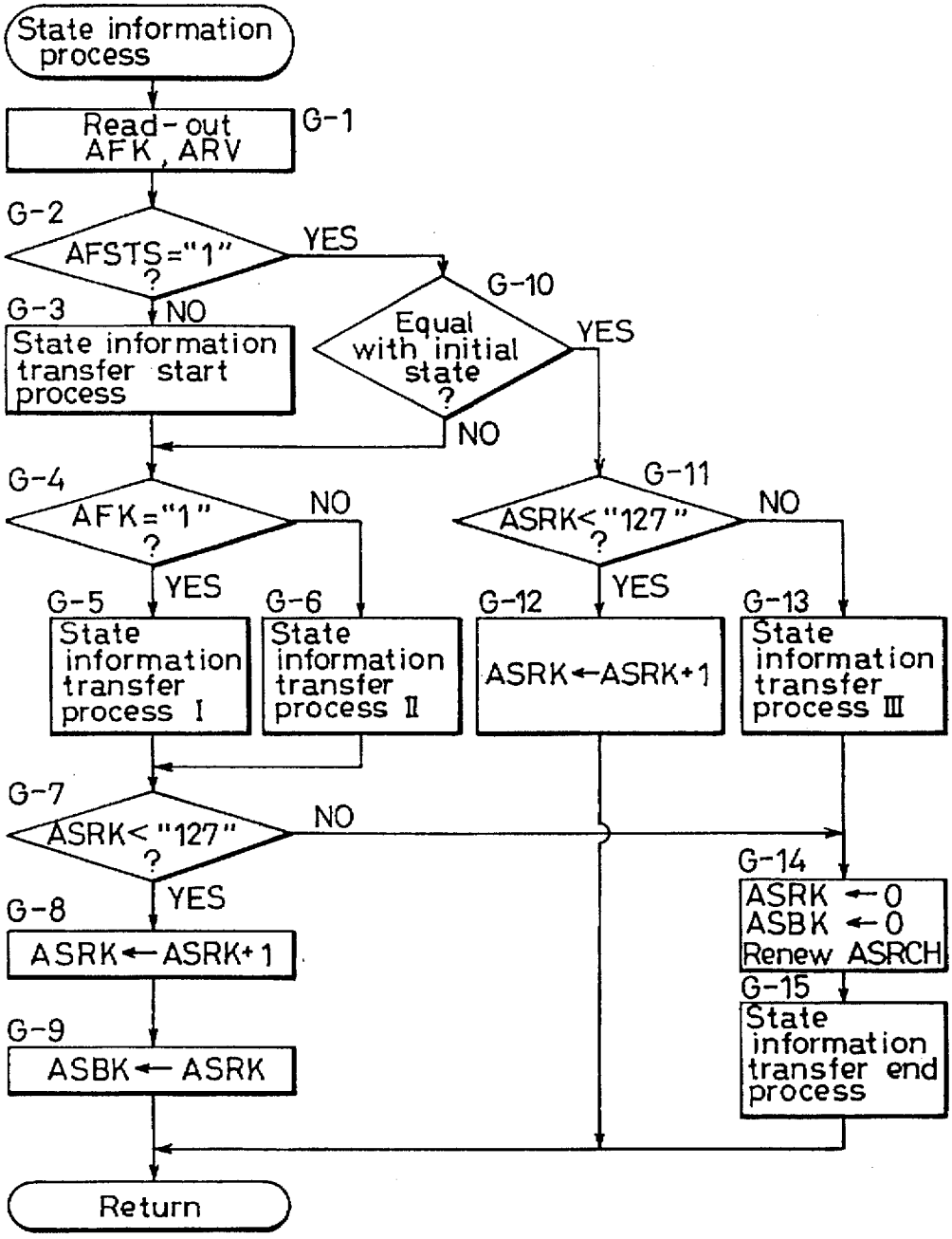

Next, description on the state information process routine is given referring to the FIG. 6.

State information is transmitted in conformity to the system exclusive message, and as shown in the FIG. 12, format of the state information comprises the header message consisting of "F0H" indicating the exclusive status, Manufacture ID (MAN), Device ID (DEV), Model ID (MDL) and Command ID (CMD), a data body consisting of more than one set of state data and "F7H" indicating the end of system exclusive. In this embodiment, the Manufacture ID (MAN) is "41H" (ID No. of applicant of this invention), the Device ID (DEV) is the state channel No. ASRCH, the Model ID (MDL) is "7EH," the Command ID (CMD) as "12H." State data comprises the state data type indicating the key-on/off state based on the note-on flag which corresponds to the note No., the note No., the velocity and check sum data which corresponds to the note No. The data body comprises one or more sets of state information.

G-1. Read out note-on flag and velocity of the MIDI channel No. and note No. which correspond to the state channel No. ASRCH and state note No. ASRK in the A-note map, respectively, and replace the note-on flag AFK, and velocity ARV with the read-out note-on flag, and velocity.

G-2. A decision is made as to whether the state information transfer process flag AFSTS is "1," indicating the state information transfer process is under way, or not. In case that the state information transfer process flag AFSTS is "1", that is, the state information transfer process is under way, go to step G-10.

G-3. On the decision in step G-2, in case that the state information transfer process flag AFSTS is decided to be not "1", since it indicates that the state information transfer process is not under way, set the state information transfer process flag AFSTS to "1," and execute the state information transfer start process by entering exclusive status up to the Command ID which comprises the header message of status information in the Transfer FIFO sequentially.

G-4 to G-6. A decision is made as to whether the note-on flag AFK is "1" or not. In case that this note-on flag AFK is "1" indicating the note-on, execute the state information transfer process I. In case of not "1," indicating note-off, execute the state information transfer process II.

1) State Information Transfer Process I

Enter first "09H" indicating the state data of note-on as a state data type, second the state note No. ASRK and third the velocity ARV sequentially in the Transfer FIFO. Next, enter the check sum data, which is given by taking two's complement for the total sum of "09H," the state note No. ASRK and the velocity ARV, and by setting the MSB bit 7 as "0", in the Transfer FIFO. The lower seven bits of the total of the check sum data given in this way, "09H", the state note No. ASRK and the velocity ARV are "0." Finally, set the transfer FIFO empty flag AFSR as "0" indicating the transfer FIFO or Real Time Transfer FIFO is not "empty" and give a demand to send to the transmitter circuit 24.

2) State Information Transfer Process II

Enter first "08H," indicating the state data of note-off as a state data type, second state note No. ASRK, and the velocity ARV sequentially in the Transfer FIFO. Next, enter the check sum data which is given by taking two's complement for the total of "08H," the state note No., ASRK and the velocity ARV and by setting the MSB bit 7 as "0" in the Transfer FIFO. Finally, set the Transfer FIFO flag AFSR as "0" indicating the transfer FIFO or Real Time Transfer FIFO is not "empty" and give a demand to send to the transmitter circuit 24.

G-7. A decision is made as to whether state note No. ASRK is less than "127" or not. In case that this state note No. ASRK is not less than "127," go to step G-14.

G-8. On the decision in step G-7, in case that the state note No. ASRK is decided to be less than "127," the state note No. ASRK is increased by "1" so that the state information of next state note No. is processed next time.

G-9. Replace the reopened state note No. ASBK with the state note No. ASRK and return to the routine.

G-10. On the decision in step G-2, in case that the state information transfer process flag AFSTS is decided to be "1," indicating that state information is under process, a decision is made as to whether the note-on flag AFK and velocity ARV are equal to the initial state wherein the note-on flag AFK is "1" indicating a note-on and the velocity ARV is "0," or the note-on flag AFK is "0" indicating a note-off and the velocity ARV is "64." In case that it is not equal to the initial state, return to step G-4.

G-11 to G-13. On the decision in step G-10, in case that data is decided to be the equal to the initial state, a decision is made as to whether the state note No. ASRK is less than "127" or not. In case that this state note No. ASRK is less than "127," the number of state note No. ASRK is increased by "1" and return to the main routine. In case of not less than "127," execute the state information transfer process III.

3) State Information Transfer Process III

Since the note No. is the final note No. "127" of this MIDI channel, the data are transmitted in order to finish the transmission temporarily. If the data is equal to the initial state, execute the same process with the state information transfer process I after the velocity ARV is set as "0."

G-14, G-15. Since the state information transfer process of this MIDI channel is over, the preparation for a state information transfer process of the next MIDI channel will be executed as follows:

First, set the state note No. ASRK and reopened state note No. ASBK as "0," initial state. Next, update the state channel No. ASRCH by adding "1" when it is less than "15" and by setting "0" when the state channel No. ASRCH is "15".

Next, enter "F7H" of the end of system exclusive indicating the end of transfer in the Transfer FIFO and set the Transfer FIFO empty flag AFSR to 0" indicating that the Transfer FIFO or Real Time Transfer FIFO is not "empty" and give a send demand to the transmitter circuit 24. Also, set the state information transmit processing flag AFSTS to "0" indicating that state information transfer process is not under way. When the preparation for the state information transfer process of the next MIDI channel is finished, return to the main routine.

In brief, in the state information process routine (Step G), when starting the transfer process of the state information, first execute the transfer process of the header message of state information and next the transfer process of the state data. In case of a continued the transmit process, execute the transfer process of the state data without transferring the header message of the state information. When the state data is transferred, state note No. ASRK is updated in order to deal with the next process and when reaching the final note No., the transfer process of the state information is finished temporarily.

Further, in transferring the state data, the state data of note No. at the starting time of transfer and the state data of note No. at the ending time of transfer are transmitted regardless of the data being equal to the initial state or not. In case that the in-between state data is not equal to the initial state, it is transmitted and in case of being equal, the transferred amount is reduced without transmission. Also, the reopened state note No. ASBK is updated only when the data is transferred so that the amount of data transferred is minimized at the time of a transmission suspension process in the main routine and the transmission can be reopened from the next note No. of the last state data transferred.

Next, in describing about a Receiver FIFO, an OUT FIFO and a Real Time OUT FIFO in the working area which is defined in the B-RAM 33C is given before describing about the function of the performance information receiver device 30 constructed in the afore-mentioned manner.

Receiver FIFO

A first in/first out memory (FIFO) to be used for storing the MIDI messages and state information except for the system real time message read out from the receive buffer of the receiver circuit 31.

OUT FIFO

A first in/first out memory (FIFO) to be used for transferring the MIDI messages except for the system real time message.

Real Time OUT FIFO

A first in/first out memory (FIFO) to be used for transferring the system real time message.

These Receiving FIFO, OUT FIFO and Real Time OUT FIFO are constructed in the similar manner as the afore-mentioned FIFOs and perform the writing in and reading out operations.

The various registers which store each variable, table, buffer, flag, and pointer or the like are presumed to be assigned at the predetermined area of B-RAM 33C in a same manner as the A-RAM 22c.

Figure 13:
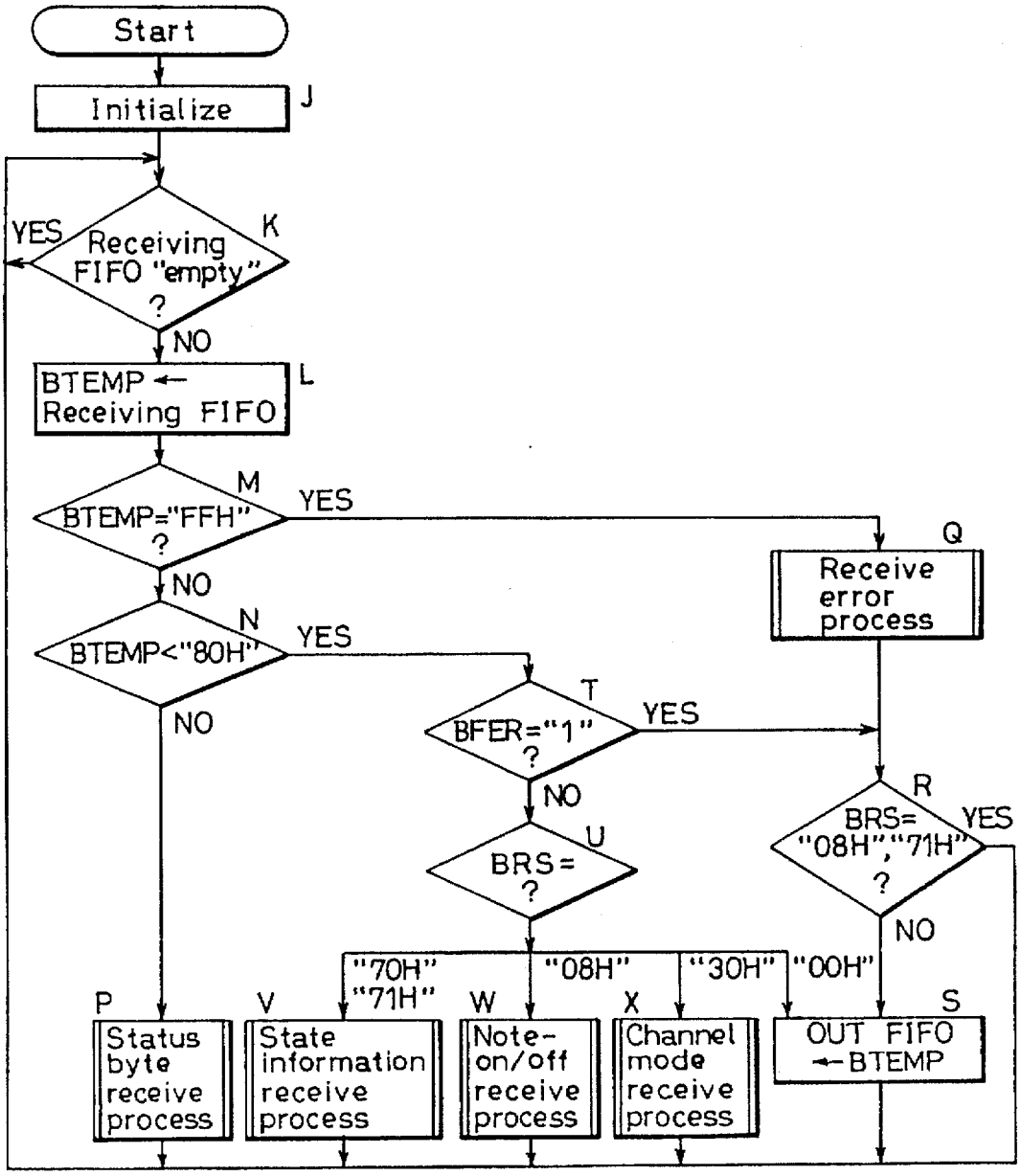

Next, the basic function of the performance information receiver device 30 is described based on the flow chart of a main routine on receiving as shown in FIG. 13.

J. Power supply is turned on in order to start up execution of the predetermined programs and the contents of B-RAM 33C are initialized by which the contents of various registers and all of FIFOs defined in the B-RAM 33C are cleared and concerning the all note Nos. of all MIDI channel Nos. on the B-note map, the note-on flag is set as "1" and the velocity is set to "0". Further, the receiver buffer of the receiver circuit 31 and the out buffer of the B-MIDI circuit 33D are cleared and initialized.

K. A decision is made as to whether the Receiving FIFO of the B-RAM 33C is empty or not. When the Receiving FIFO is empty, repeat step K.

L. On the decision in step K, in case that Receiving FIFO is decided to be not "empty" and the MIDI messages except for the system real time message is entered, one byte of the MIDI message is passed through from the Receiving FIFO and replace a temporary data BTEMP, which is a temporary data under process with it.

M. A decision is made as to whether the temporary data BTEMP is "FFH", that is the received data is a receiving error mark or not, which is set when the received data is an error, in the receive interruption process routine to be referred to later. In case that this temporary data BTEMP is "FFH", that is, the receive data is a receiving error mark, go to the step Q.

N. On the decision in step M, in case that temporary data BTEMP is decided to be not "FFH", that is, the received data is not the receiving error mark, the temporary data BTEMP is decided to be less than "80H" or not. In case of less than "80H," go to the step T and not less than "80H," go to the next step P.

P. A status byte receiver process routine. In case of the temporary data BTEMP not being less than "80H," since this temporary data BTEMP is a status byte, status byte processing is executed such as setting the message code BRS indicating the message type of this MIDI message for decoding a data byte to be followed, by decoding of the temporary data BTEMP. Details will be described later referring to the flow chart shown as FIG. 14. After the status byte receive process, return to step K.

Q. A Receiver error process routine. Execute the process on the receiving error. Details will be referred to later according to the flow chart shown in FIG. 15.

R. A decision is made as to whether the message code BRS is "08H" or "71H." In case that this message code BRS is either "08H" or "71H," return to step K, leaving the temporary data BTEMP as it is, since it is of no use in the end.

S. On the decision in step R, in case that the message code BARS is decided to be neither "08H" nor "71H, enter the temporary data BTEMP in the OUT FIFO, enable the the B-MIDI circuit 33D and return to step K.

T. On the decision in step N, in case that the temporary data BTEMP is decided to be less than "80H", that is, it is a data byte and another decision is made as to whether the receiver error flag BFER, which is set as "1" in the receive error process routine (step Q) at the time of a data processing including the transfer error and set to "0" in the status byte receive process routine (step P) at the time of starting a new MIDI message, is "1" or not. In case of "1," return to the step R, since the preceding data which comprise the MIDI message contains a transfer error so that the decoding of this temporary data BTEMP is difficult.

U. On the decision in step T, in case that the receive error flag BFER is decided to be "0", that is, the transfer error is not included in the MIDI message, a decision is made as to which one of the "70H", "71H", "08H", "30H", or "00H" is the message code BRS. In case of "70H" or "71H," go to the step V. In case of "08H," go to the step W. In case of "30H," go to the step X. And if it is "00H," return to the the step S, since the temporary data BTEMP is the data byte of MIDI message which does not correspond to either of state information, note-on, note-off or channel mode.

V. A State Information Receive Process routine. In case that the message code BRS is "70H" or "71H," since the temporary data BTEMP is state information or may be state information, execute the state information receiver process. In case of being state information, a comparison is made between the decoded state information and the B-note map. If there is a difference between the two, B-note map is updated and stored and a process of transferring the MIDI message for amendment is executed. Detail will be referred to later according to the flow chart shown in the FIG. 16 A, 16B. After the state information receive process, return to the step K.

W. A note on/off receive process routine. In case of the message code BRS being "08H," since the temporary data BTEMP is a data byte corresponding to the note-on or a note-off, note on/off receive process such as storing or updating the B-note map is executed. Detail will be referred to later according to the flow chart shown in the FIG. 17. After the note-on/off process, return to step K.

X. A channel mode receive process routine. In case that the message code BRS being the "30H," there is a possibility of the temporary data BTEMP being a data byte corresponding to the all note-off included in the channel mode. Thus, the channel mode receive process is executed. In case of being all note off, B-note map is stored or updated. Details will be referred to later according to the flow chart shown in the FIG. 18. After the channel mode receiver process, return to the step K.

In brief, based on the MIDI message and state information from the receiver circuit 31, a process of storing and updating the B-note map takes place. Further the transferring process of the MIDI message and MIDI message for amendment to the MIDI bus 34 is executed. If something is wrong with the receiving, the updating of the B-note map is stopped. State information itself is not transferred to the MIDI bus 34 and the MIDI message of note-on and note-off is not transferred to the MIDI bus 34 at the time of abnormal receiving. As to the other MIDI message, a transferring process to the MIDI bus 34 is executed in the same manner and a process for dealing with the error will be done at an equipment connected to the MIDI bus 34 at the time of abnormal receiving.

Next, description is given on each interruption process routine of receive interruption process routine and MIDI OUT interruption process routine before describing about each sub-routine of the status byte receive process routine (Step P), receive error process routine (Step Q), state information receive process routine (Step V), note-on/off receive process routine (Step W) and channel mode receive process routine(Step X).

Figure 19:
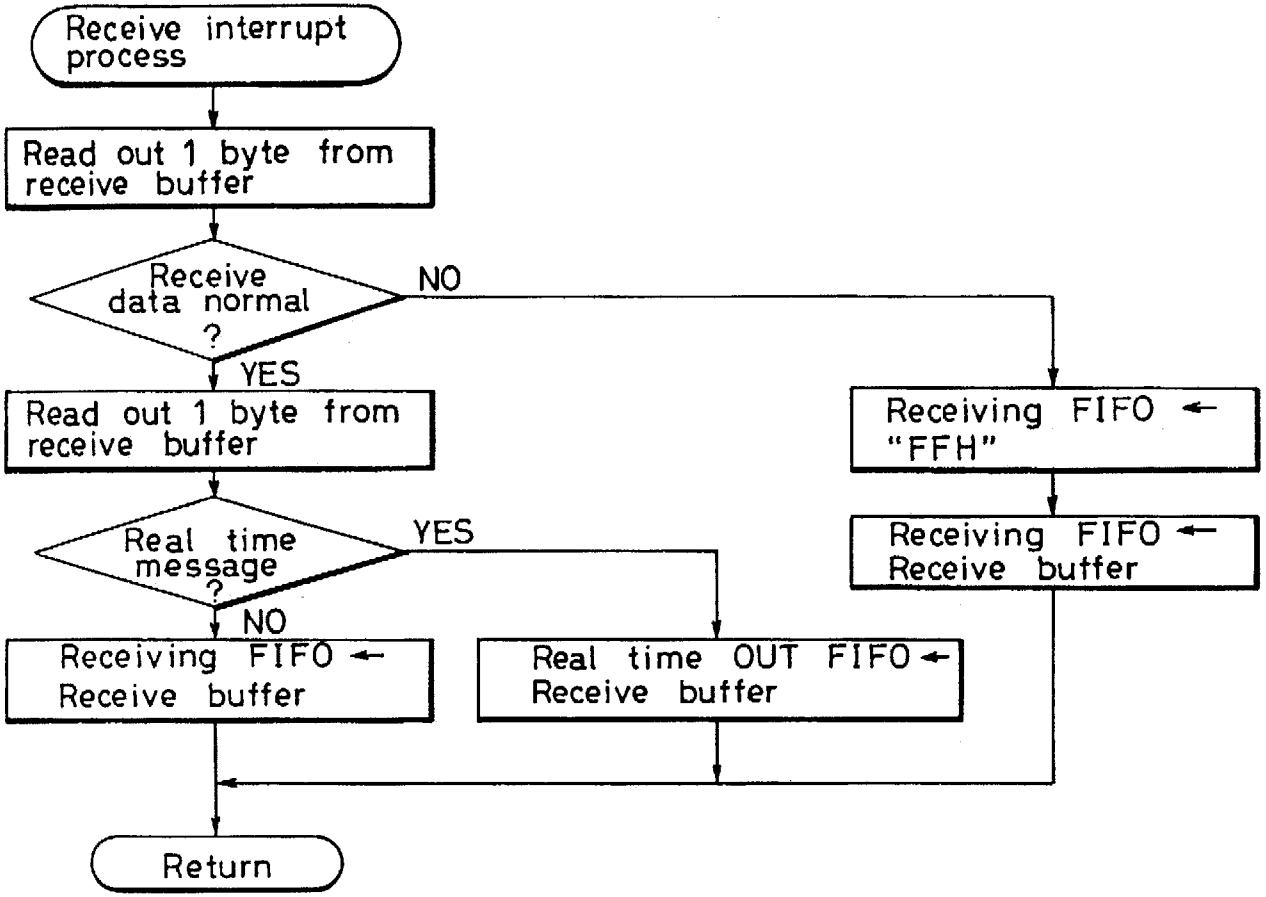

Receive Interruption Process Routine (FIG. 19)

A receive interruption is requested when one unit (=2 byte) of the receiver data which is inputted through the receive antenna, modulated and taken out is accumulated in the receive buffer of the receiver circuit 31. And following process is executed.

Parity data which is a first byte of the receiver data accumulated in the receiver buffer is read out. In case that the read-out parity data are "00H" indicating no error in the transfer, read out the data body which is a second byte. In case that the read-out data body is the MIDI message of system real time message, enter the MIDI message in the Real Time OUT FIFO and enable the B-MIDI circuit 33D. Further, in case of being the MIDI message or state information except for the system real time message, enter that MIDI message or state information to the Receiving FIFO.

When the read-out parity data is "01H"indicating abnormality of an error of transfer, enter "FFH" as the receive error mark in the Receiving FIFO. Though the system real time message is also "FFH," since it is a real time message not being entered in the Receiver FIFO, it is used as a receive error mark. Next, the data body which is a second byte, and the MIDI message or state information are entered in the Receiving FIFO from the receive buffer.

In brief, in the receive interruption process routine, when the received data is read out from the receive buffer of the receiver circuit 31, that is, the data body is a system real time message having no transfer error, a transfer process to the MID bus 34 is executed. In case that the received data is no transfer error and is the MIDI message or state information except for a system real time message, enter in the Receiving FIFO. In case of being transfer error in the data body, enter in the Receiving FIFO by adding the error mark.

Figure 20:
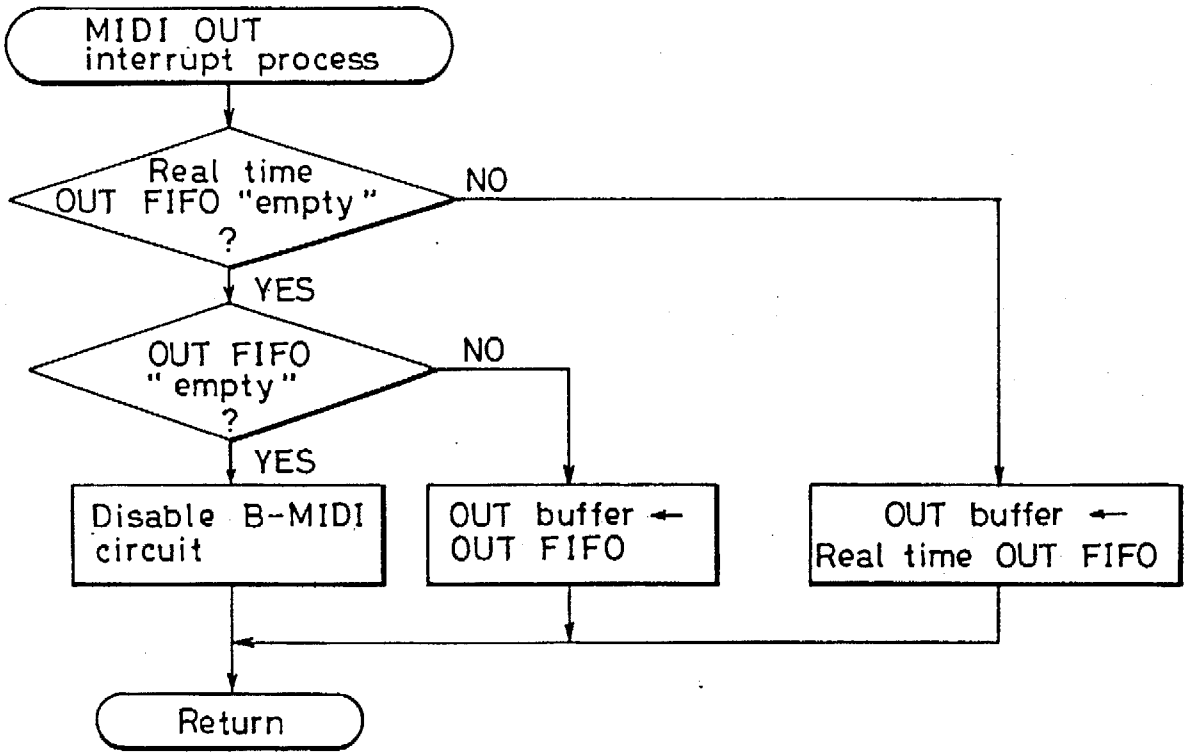

MIDI OUT Interrupt Process Routine (FIG. 20)

A MIDI OUT interruption is requested when the B-MIDI circuit is in an enable condition even after the MIDI message which is read out from the OUT buffer to the MIDI bus 34 was outputted, and the following process is executed.

In case that the system real time message remains in the Real Time OUT FIFO, one byte is taken out from Real Time OUT FIFO and is accumulated in the OUT buffer.

In case that the MIDI message, except for the system real-time message, remain in the OUT FIFO, one byte is taken out from the OUT FIFO and is accumulated in the OUT buffer.

In case that the system real time message does not remain in the Real Time OUT FIFO and the MIDI message, except for the system real time messages, does not remain in the OUT FIFO, disable the B-MIDI circuit 33D.

In brief, in the MIDI OUT interruption process routine, in case that the system real time message remains, one byte of the system real time message is taken out and is accumulated in the OUT buffer. In case that the system real time message does not remain but the MIDI message, except for the system real time message, remains, one byte of the MIDI message, except for the system real time message, is taken out and is accumulated in the OUT buffer.

Figure 14:
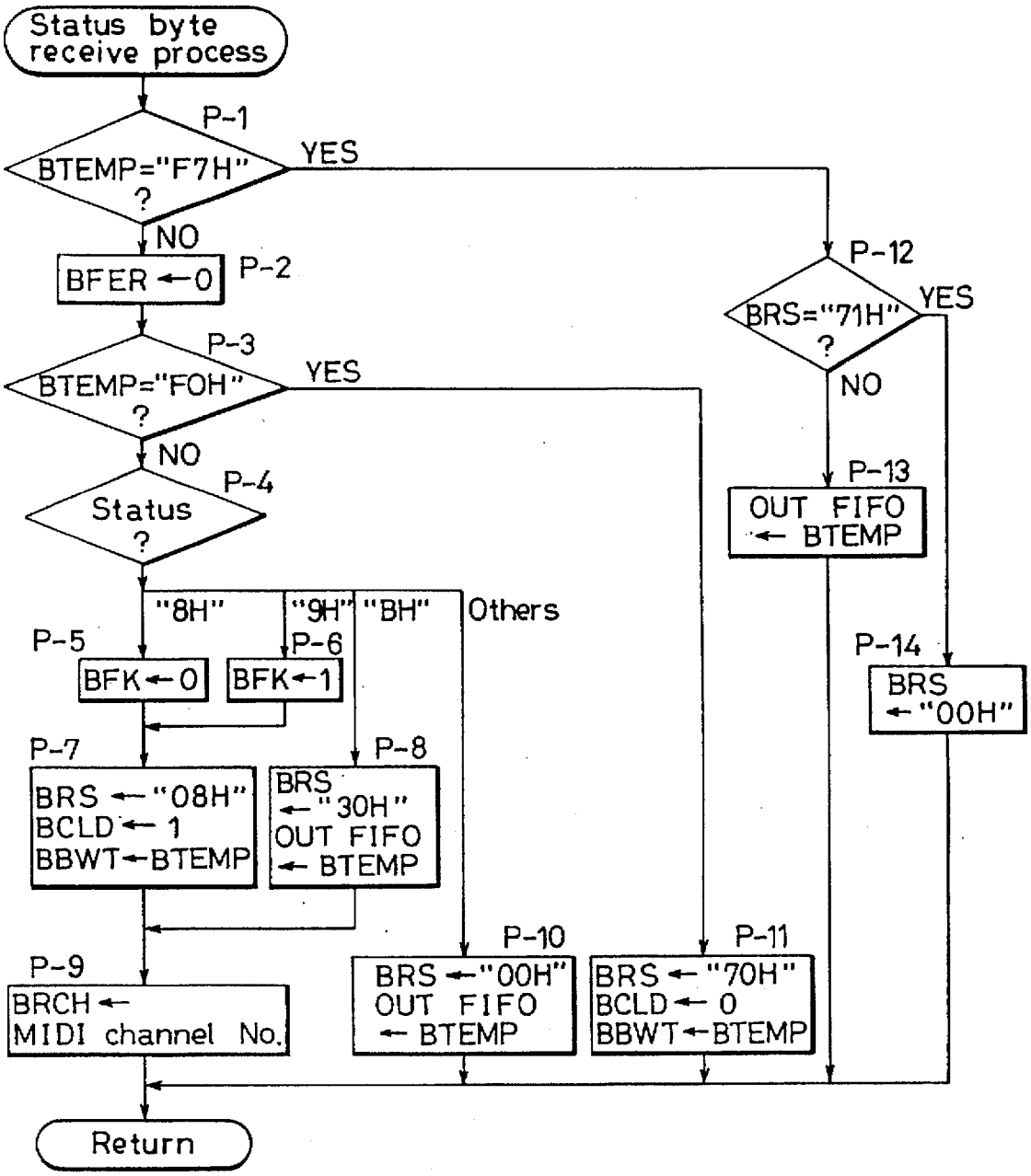

Next, description is given on the status byte receive process routine (Step P), referring to the FIG. 14.

P-1. A decision is made as to whether the temporary data BTEMP is "F7H," indicating the end of system exclusive or not. In case of "F7H," go to the step P-12.

P-2. On the decision in step P-1, in case that the temporary data BTEMP is decided to be not "F7H", since it is a start of a new MIDI message, the receive error flag BFER is set as "0" indicating no transfer error is included in the preceding data.

P-3. A decision is made as to whether the temporary data BTEMP is the system exclusive message or the state information of the status "FOH," In case of "FOH," go to step P-11.

P-4 to P-6. On the decision in step P-3, in case that the temporary data BTEMP is decided to be not "FOH," the status of the temporary data BTEMP is decided whether the upper four bits being "8H," "9H,"BH" or other. In case of "8H," since the status of temporary data BTEMP is a note-off, the note-on flag BFK is set as "0." In case of "9H," since the status of the temporary data BTEMP is a note-on, the note-on flag BFK is set as "1." In case of "BH," go to step P-8. In case of neither "8H," "9H," nor "BH," go to step P-10.

P-7. The message code BRS is set as "08H," indicating the note-on or note-off, and the data byte BCLD indicating the decoding step of data byte of the temporary data BTEMP is set as "1". And the temporary data BTEMP is accumulated in the stand-by buffer BBWT wherein the temporary data BTEMP is kept waiting temporarily until the completion of the receiving. Further, the stand-by buffer BBWT is constituted as FIFO so that plural temporary data can be stored sequentially and writing in and reading out are executed in a same manner as above-mentioned FIFO.

P-8. On the decision in step P-4, case that the upper four bits is decided to be "BH," since it is a channel mode or control change, the message code BRS is set as "30H", hinting the possibility of a channel mode, and the temporary data BTEMP is entered in the OUT FIFO. Also, enable the B-MIDI circuit 33D.

P-9. The channel No. BRCH is replaced with the MIDI channel No. represented by the lower four bits of the temporary data BTEMP.

P-10. On the decision in step P-4, in case that the upper four bits is decided to be neither "8H," "9H" nor "BH", the message code BRS is set as "00H." Next, the temporary data BTEMP is entered in the OUT FIFO and the B-MIDI circuit 33D is enabled.

P-11. On the decision in step P-3, in case that temporary data BTEMP is decided to be "FOH", the message code BRS is set as "70H" indicating the header message of the system exclusive message or the header message of state information, the data byte BCLD indicating the decoding step of data byte of the temporary data BTEMP is set as "0" and the temporary data BTEMP is accumulated in the stand-by buffer BBWT.

P-12 to P-14. On the decision in step P-1, in case that the temporary data BTEMP is decided to be "F7H", a decision is made as to whether the message code BRS is "71H" indicating state information. If not "71H," indicating not the end of the state information, the temporary data BTEMP is entered in the OUT FIFO and enable the B-MIDI circuit 33D. In case of "71H," indicating the end of the state information, set the message code BRS as "00H."

In brief, in the status byte receiving process routine (step P), a decision is made as to whether one byte of the MIDI message passes through from the Receiver FIFO is the end of system exclusive (F7H) or not. If not, execute the decoding preparation for the data byte to be followed corresponding to the MIDI message.

Figure 15:
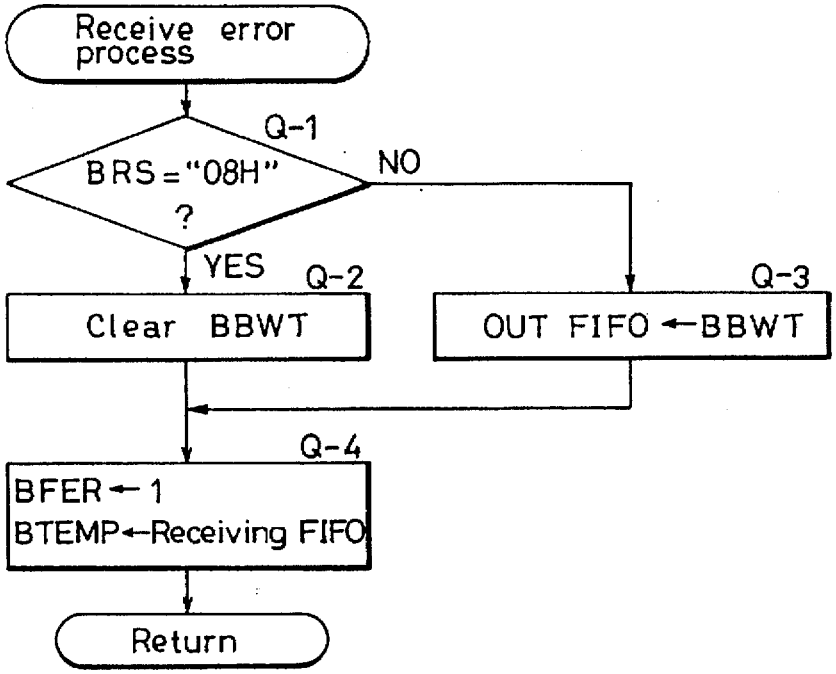

Next, description is given of the receiver error process routine (step Q), referring to the FIG. 15.

Q-1 to Q-3. In case that the message code BRS is not "08H" indicating a note-on or note-off, the header message of the system exclusive message or the header message of state information accumulated in the stand-by buffer BBWT are entered in the OUT FIFO by reading them out and enabling the B-MIDI circuit 33D. In case of "08H," clear the stand-by buffer BBWT, that is, by coinciding the readout pointer of stand-by buffer BBWT to the writing-in pointer.

Q-4. Set the receiver error flag BFER as "1" indicating that a transfer error is included in the preceding data. Next, one byte is passed through from the Receiving FIFO in which the MIDI message, except for the system real time message, has been entered, thereby replacing the temporary data BTEMP with it. And return to the main routine.

In brief, in the receive error routine (step Q), in case that the data accumulated in the stand-by buffer BBWT is the data of a note-on or note-off at the time of receiving error, stop the transfer. In other case, execute the transfer process.

Figure 16A:
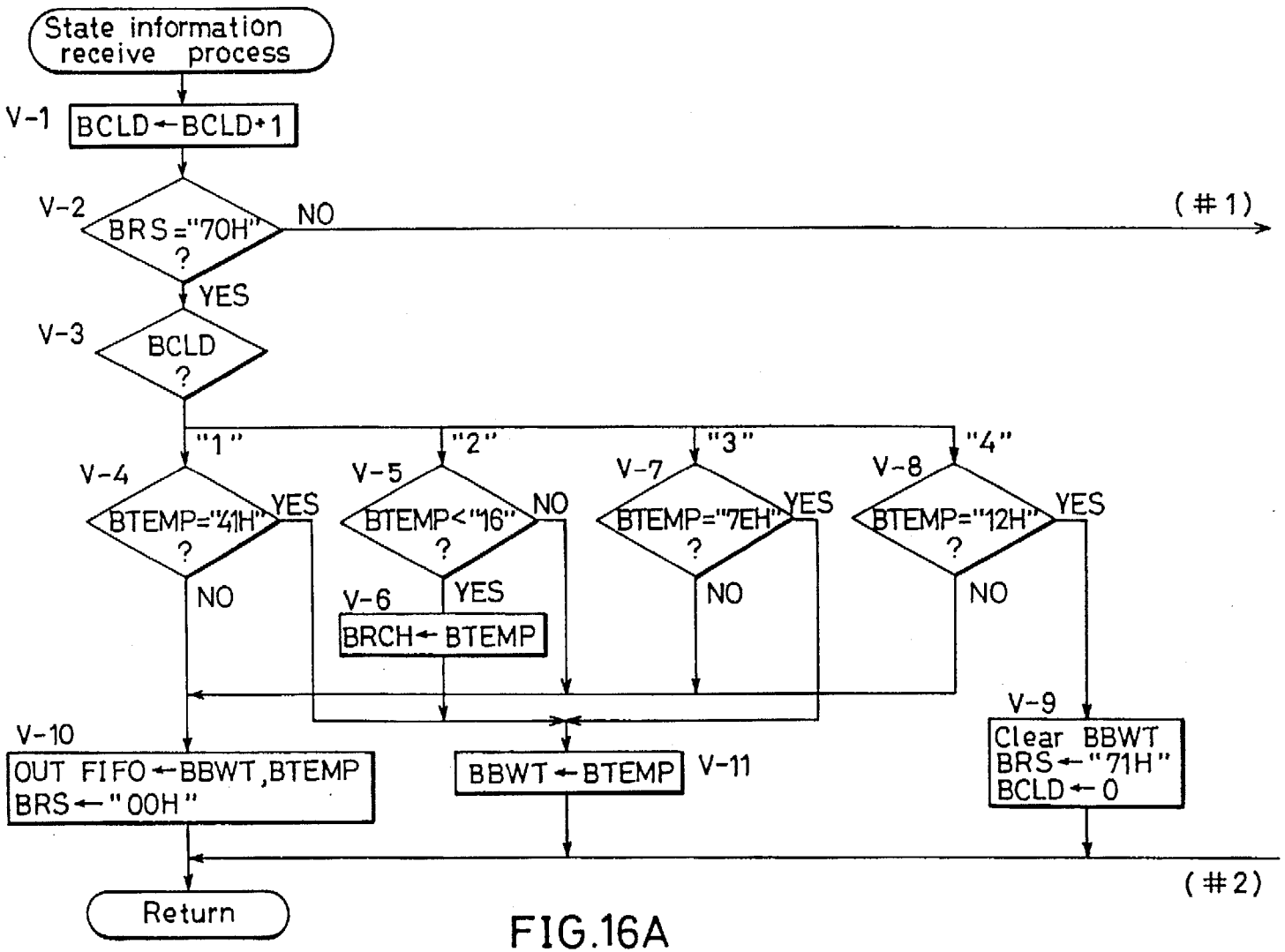
Figure 16B:
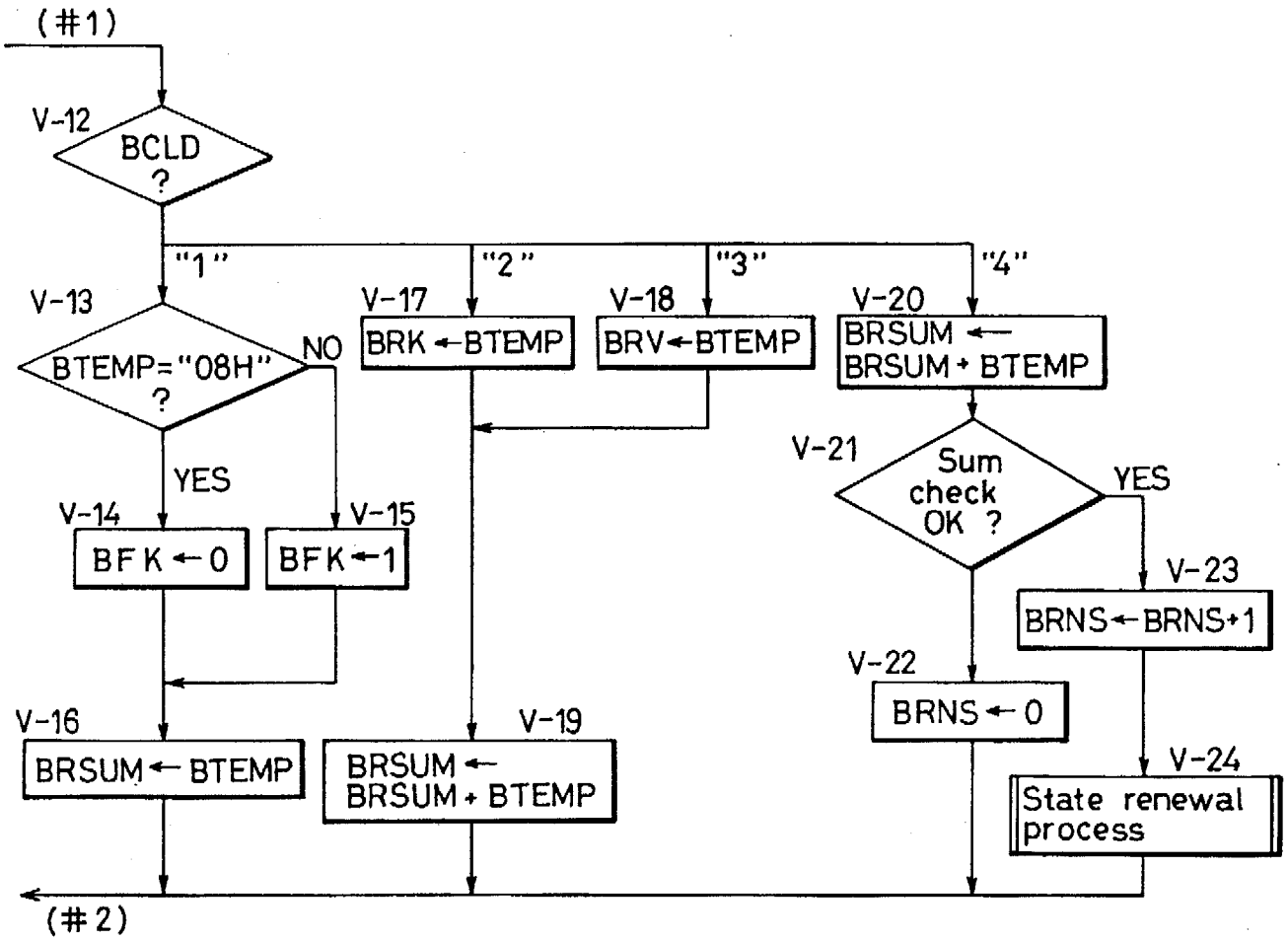

Next, description is given of the state information receive process routine (step V), referring to the FIG. 16.

V-1. The data byte BCLD indicating the decoding step of data byte is increased by "1."

V-2. A decision is made as to whether the message code BRS is "70H" indicating the header message of the system exclusive message or the header message of the state information. In case of not "70H," go to step V-12.

V-3. On the decision in step V-2, in case that the message code BRS is "70H", decisions are made as to whether the data byte BCLD is either "1," "2," "13," or "4". In case of "1," go to the next step V-4, in case of "2," go to step V-5, in case of "3," go to step V-7, in case of "4," go to step V-8.

V-4. On the decision in step V-3, in case that the data byte BCLD is decided to be "1", since the temporary data BTEMP is the Manufacture ID, a decision is made as to whether this temporary data BTEMP is "41H" or not. If not, go to the step V-10. In case "41H," go to the step V-11.

V-5, V-6. On the decision in step V-3, in case that data byte BCLD is decided to be "2", since the temporary data BTEMP is the Device ID, a decision is made as to whether this temporary data BTEMP is less than "16" or not. In case of less than "16," since the MIDI channel No. is employed as the Device ID, the channel No. BRCH is replaced with the temporary data BTEMP. In case of not less than "16," go to step V-10.

V-7. On the decision in step V-3, in case that the data byte BCLD is decided to be "3", since the temporary BTEMP is the Model ID, a decision is made as to whether this temporary data BTEMP is "7EH." In case of not "7EH," go to step V-10, and in case of "7EH," go to step V-11.

V-8, V-9. On the decision in step V-3, in case that data byte BCLD is decided to be "4", since the temporary data BTEMP is the Command ID, a decision is made as to whether this temporary data BTEMP is "12H" or not. In case of "12H," clear the stand-by buffer BBWT, set the message code BRS as "71H" and set the data byte BCLD and state data number BRNS as "0" in preparation for the state data, since it is the end of a process of the header message of the state information. In case of not "12H", go to step V-10.

V-10. On the decision in step V-4, V-5, V-7 and V-8, in case that the temporary data BTEMP is decided to be not "41H," "less than 16H," "7EH" or "12H" indicating the state information of the Manufacture ID, Device ID, Model ID or Command ID, since the temporary data BTEMP is a MIDI message of the system exclusive message, enter the content of the stand-by buffer BBWT by reading it out and the temporary data BTEMP in the OUT FIFO and enable B-MIDI circuit 33D. Next set the message code BRS as "00H" indicating the MIDI message that it does not correspond to either state information, note-on, note-off or channel mode and return to the main routine.

V-11. On the decision in step V-4, V-5, and V-7, in case that the temporary data BTEMP is decided to be either "41H," less than 16H," "7EH" or "12H," indicating state information of the Manufacture ID, Device ID or Model ID, the temporary data BBWT is accumulated in the stand-by buffer BBWT by an additional writing and return to the main routine.

V-12. On the decision in step V-2, in case that the message code BRS is decided to be not "70H," a decision is made as to whether this data byte BCLD is either "1," "2," "3," or "4." In case of "1," go to step V-13, in case of "2," go to step V-17, in case of "3," go to step V-18 and in case of "4," go to step V-20.

V-13 to V-16. On the decision in step V-12, in case that the data byte BCLD is decided to be "1," since the temporary data BTEMP is the state data type, a decision is made as to whether this temporary data BTEMP is "08H," indicating a note-off. In case of "08H," set the note-on flag BFK as "0." In case of not "08H" if a note-on, set the note-on flag BFK as "1." Next, the check sum calculation value BRSUM is replaced with the temporary data BTEMP and return to the main routine.

V-17 to V-19. On the decision in step V-12, in case that the data byte BCLD is decided to be "2," since the temporary data BTEMP is a state note No., replace the note No. BRK with this temporary data BTEMP. In case that data byte BCLD is "3," since the temporary data BTEMP is a velocity, replace the velocity BRV with this temporary data BTEMP. Next, add the temporary data BTEMP which is a state note No. or velocity, to the check sum calculation value BRSUM and thereby replacing a new check sum calculation value BRSUM with it and return to the main routine.

V-20. On the decision in step V-12, in case that data byte BCLD is decided to be "4," since the temporary data BTEMP is a check sum data, add this temporary data BTEMP to the check sum calculation value BRSUM and thereby replacing a new check sum value BRSUM with it. Also, in preparation for the next data processing, set the data byte BCLD as "0."

V-21, V-22. A decision is made as to whether all the bits from bit 0 to bit 6 of the check sum calculation value BRSUM are "0." In case all the bits are not "0," since it is an error data, set the state data number BRNS, which calculate the number of state data normally received, as "0" in preparation for the processing of the next state data.

V-23. On the decision in step V-21, in case that all the bits are decided to be "0", indicating received normally all the bits are, the state data number BRNS is increased by "1.

V-24. A state renewal process routine. In case that there is a difference between the received data and B-note map, renew the B-note map and execute the note-on/off information amendment process. Details will be described later referring to the flow chart shown in FIG. 21. After the state renewal process, return to the main routine.

In brief, in the state information receive process routine (step V), a decision is made as to whether temporary data BTEMP is a header message of the state information or the exclusive message in step V-2 to V-11. In case of the header message of the state information, make the message code BRS indicate state information. And in case of the header message of the exclusive message in the MIDI messages, enter the preceding data accumulated in the stand-by buffer BBWT in the OUT FIFO. Further, give instruction to enter the data to be followed which comprise the exclusive message in the OUT FIFO. In step V-12 to V-24, an amendment process of note-on/off information is executed by doing the decoding process of state information.

Instead of the process of setting the state data number BRNS as "0" in step V-22, it is possible to ignore the data up to the end of the state information by setting the receive error flag BFER as "1."

Figure 21:
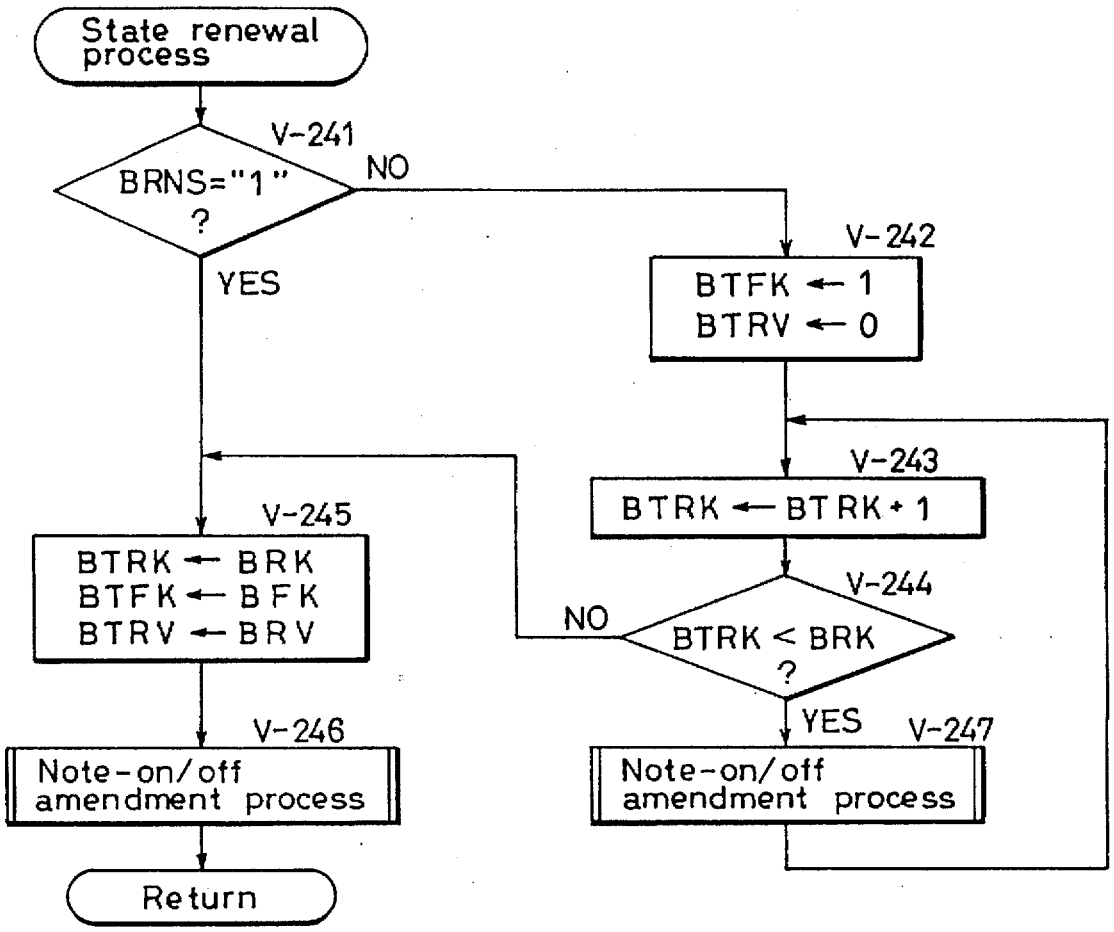

Next, description is given on a state renewal process routine (step V-24), referring to the FIG. 21.

V-241, V-242. A decision is made as to whether the state data number BRNS is "1" or not. In case of not "1," set the note-on flag temporary value BTFK as "1" and set the velocity temporary value BTRV as "0." Further, in case that the state data number BRNS is "1," go to step V-245.

V-243, V-244. A note No. temporary value BTRK is increased by "1" and a decision is made as to whether this increased note No. temporary value BTRK is less than the note No. BRK. In case that the note No. temporary value BTRK is less than the note No. BRK, go to step V-247.

V-245 On the decision in step V-241, in case that the state data number BRNS is decided to be "1," or on the decision in step V-242, in case that the note No. temporary value BTRK is decided to be not less than the note No. BRK, replace the note No. temporary value BTRK with the note No. BRK, the note-on flag temporary value BTFK with the note-on flag BFK and the velocity temporary value BTRV with the velocity BRV.

V-246, V-247. The note-on/off amendment process is executed. After the end of the process of step V-246, return to the state information receive process routine and after the end of the process of step V-247, return to step V-243. Details will be described later referring to the flow chart shown in the FIG. 22.

In brief, in the state renewal process routine (step V-24), in case that the state data number BRNS is "1" or the note No. temporary value BTRK is same as the note No. BRK, since the state information of this note No. BRK have been given, execute the state information process of the note No. BRK. In case that the state date number BRNS is more than "1" and the note No. temporary value BTRK is not same as the note No. BRK, execute the state information process, since the state information have been given the one which is equal with the initial state as for the next note No. of the previous note No. to the previous note No. of present note No. BRK.

Figure 22:
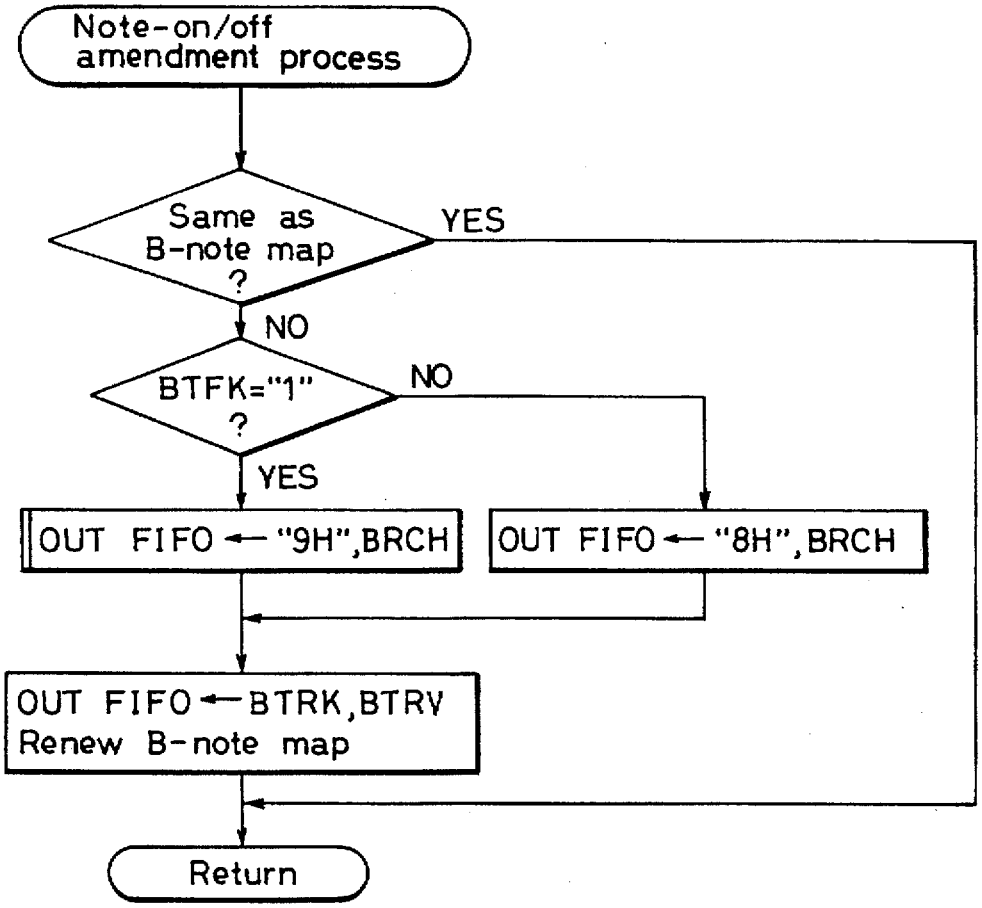

Next, description is given on the note-on/off process routine (step V-246, V-247), referring to the FIG. 22.

A comparison is made between the note-on flag and velocity of MIDI channel No. which correspond to the channel No. BRCH and of the note No. which correspond to the note No. temporary value BTRK in the B-note map, and the note-on flag temporary value BTFK and the velocity temporary value BTRV. In case of a different, a decision is made as whether the note-on flag temporary value BTFK is "1" or not. In case that the note-on flag temporary value BTFK is "1," enter the one byte in which the upper four bits were set in "9H" and the lower four bits were set in channel No. BRCH, in the OUT FIFO.

In the case that the note-on flag temporary value BTFK is not "1", enter the one byte in which the upper four bits were set in "8H" and the lower four bits were set in channel No. BRCH, in the OUT FIFO.

Next, enter the note No. temporary value BTRK and velocity temporary value BTRV sequentially in the OUT FIFO, and enable the B-MIDI circuit 33D. Replace the note-on flag and velocity of the MIDI channel No. which correspond to the channel No. BRCH and of the note number which correspond to the note number temporary memory value BTRK, in the B-note map with the note-on flag temporary value BTFK and velocity temporary value BTRV.

As mentioned before, the state in which a note-on flag is "1" and a velocity is "0" and the state in which a note-on flag "0" and a velocity "64" are equal states indicating a same state.

In brief, in the note-on/off amendment process routine (step V-246, step V-247), in case that the note-on flag and velocity of the B-note map are not the same as the note-on flag temporary value BTRV and velocity temporary value BTRV, the transferring process outputting the MIDI message for amendment to the MIDI bus 34 as a note-on message or note-off message is executed and the B-note map is renewed to the note-on flag temporary value BTFK and velocity temporary value BTRV.

Figure 17:
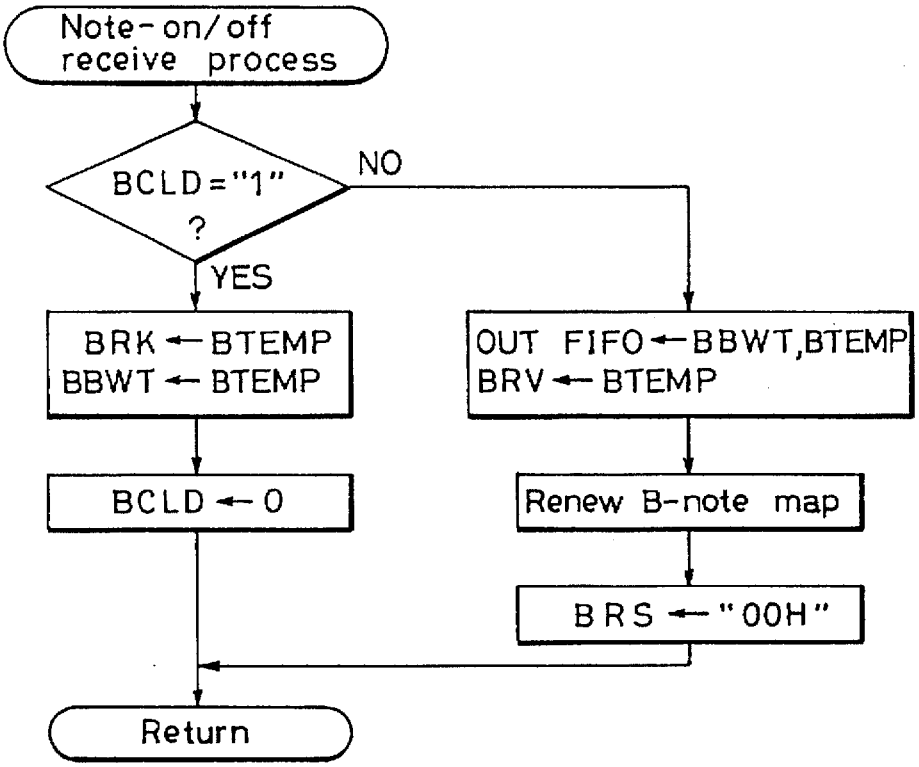

Next, description is given on the note-on/off receive process routine, referring to the FIG. 17.

A decision is made as to whether the data byte BCLD is "1" or not. In case of "1", replace the note No. BRK with the temporary data BTEMP, and accumulate it in the stand-by buffer BBWT. Next, the data byte BCLD is set to an initial state of "0".

In case that the data byte BCLD is not "1" enter the content of the stand-by buffer BBWT and the temporary data BTEMP in the OUT FIFO, replace the velocity BRV with the temporary data BTEMP, and enable the B-MIDI circuit 33D. Next, replace the note-on flag and velocity of the MIDI channel No. which correspond to the channel No. BRCH and of the note No. which correspond to the note No. BRK in the B-note map with the note-on flag BFK and the velocity BRV. And set the message code BRS as "00H" indicating a MIDI message which does not correspond either state information, note-on, note-off or channel mode since the receiving of data bytes on the note-on or note-off is completed.

In brief, in the note-on/off receiver process routine (step W), the B-note map is stored and updated based on the note No. and velocity, since one byte following the status byte in the MIDI message represent a note No. and following the one byte represent a velocity.

Figure 18:
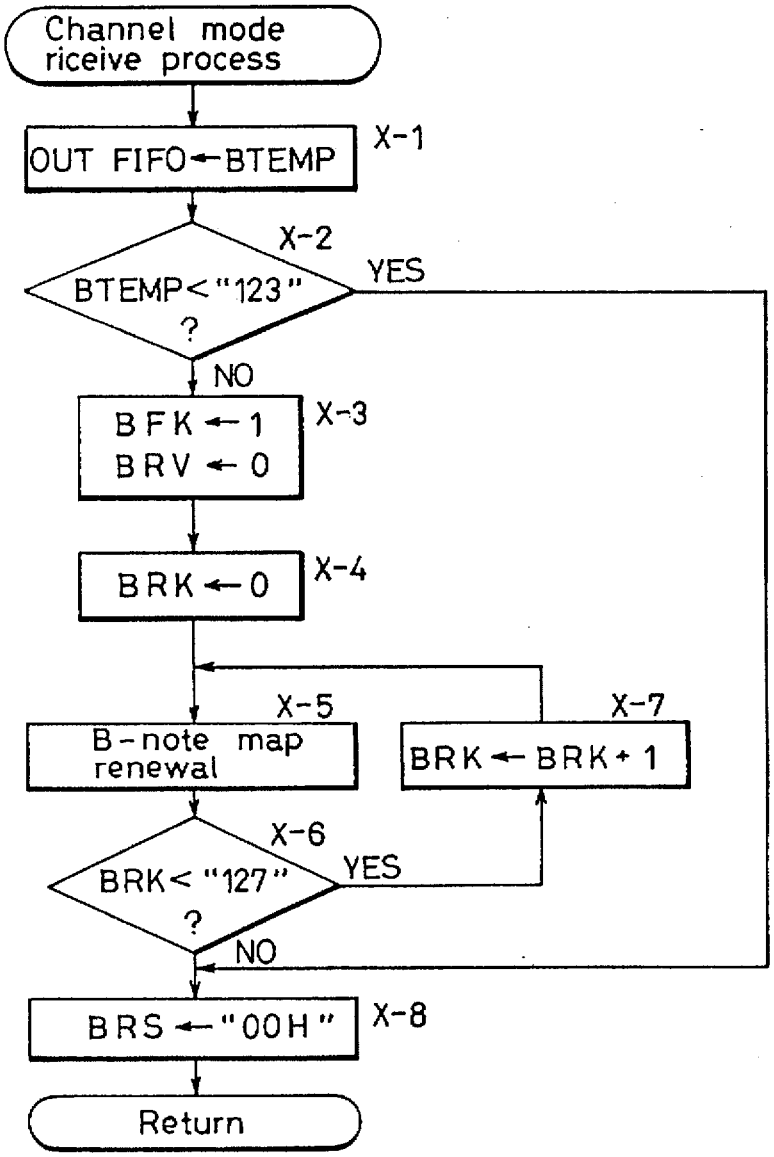

Finally, description is given on the channel mode receive process routine (step X), referring to the FIG. 18.

X-1, X-2 Enter the temporary data BTEMP in the OUT FIFO and enable the B-MIDI circuit 33 D. And a decision is made as to whether the temporary data BTEMP is less than "123", or not. In case that this temporary data BTEMP is less than "123," go to step X-8.

X-3, X-4. On the decision in step X-2, in case that the temporary data BTEMP is decided to be not less than "123," set an initial state by setting the note-on flag BFK as "1" and the velocity as "0. Further, set the note No. BRK as "0."

X-5. Replace the note-on flag and velocity of MIDI channel No. which correspond to the channel No. BRCH and of the note No. which correspond to the note No. BRK, in the B-note map with the note-on flag and BFK velocity BRV.

X-6, X-7. A decision is made as to whether the note No. BRK is less than "127" or not. In case that that this note No. BRK is less than "127," this note No. BRK is increased by "1" and return to the step X-5.

X-8. On the decision in step X-6, in case that the note No. BRK is decided to be not less than "127," since the data byte process of the channel mode is finished, set the message code BRS as "00H."

In brief, in the channel mode receiver process (step X), in case of all note-off, the data which correspond to all the note No. of the MIDI channel No. corresponding to the channel No. BRCH in the B-note map is returned to the initial state.

Next, description is given on the modified embodiment of this embodiment.

In this embodiment, in the note-on/off amendment process routine (step V-246, V-247), the status byte of a note-on or note-off, the note No. temporary value BTRK and velocity temporary value BTRV are entered in the OUT FIFO sequentially and the process of enabling the B-MIDI circuit 33D is executed. In the modified embodiment, the following procedure takes place.

In case that the OUT FIFO is "empty," they are entered in the OUT FIFO and the B-MIDI circuit 33 D is enabled. But, in case of not "empty," execute the process of entering in the OUT FIFO for Amendment which is prepared separately. That process is followed by the updating process of the B-note map. This event amendment information entered in the OUT FIFO for Amendment is passed through sequentially in case that the Real Time OUT FIFO and OUT FIFO are both "empty" and the receiving FIFO is decided to be "empty" in the step K in the receive main routine of receiving side. This event amendment information which is passed through sequentially is entered in the OUT FIFO and the B-MIDI circuit 33 D is enabled in case that it corresponds to the B-note map. In case of not, in order to evade the delay of other message by the transfer of event amendment information, it is not transferred, since the event amendment information is updated by a note-on, note-off or all note off after the update process of the B-note map. Other procedure is same with this embodiment.

Second Embodiment:

Next, description is given on the embodiment wherein performance data, which is made by a sequencer and the like and include the multiple note-on which is a key-on state of several keys by the musical tone of the same note No. being made, can be processed, focusing on the differences from the first embodiment and omitting the overlapping parts. In the first embodiment, state information is transmitted and received in accordance with the system exclusive message. In this embodiment, since it is sufficient if the state information is discerned, so that header message consists of only "F4H" indicating the status. Also, a data body is comprised a byte of state data type, note No., velocity, note-on number and check sum data. "F7H" indicating the end of system exclusive in the first embodiment is not used. In the byte of state data type in this data body, the state data type is indicated by the upper four bits and the MIDI channel No. is indicated by the lower four bits. In case of being MIDI channel as "nH," the byte of state data type is indicated by reducing "80H" from the status byte of the note-on/off message, as being a note-off as "0nH" and a note-on as "1nH."A-note map in this embodiment comprises a MIDI channel No., note No., note-on flag, velocity and note-on number. The MIDI channel No. and the note No. are the address in the A-note map in the first embodiment. The note-on flag and velocity are stored and updated by the key-on/-off information. The note-on number indicates the number of note-on corresponding to these MIDI channel No. and note No. The same can be said about the B-note map. Besides these A-note map and B-note map, a C-note map which has the similar construction with the A-note map and B-note map and is basically stored and updated by state information is defined in the B-RAM 33C.

Next, the differences between the first embodiment in each routine is described in the following.

On the Side of Performance Information Transmitter Device 20

Main Routine

In this embodiment, due to the multiple note-on data processing, in the step A, the number of note-on on all the note No. of all MIDI channel No. in the A-note map is set as "0" and a process of initial setting is added. Further, corresponding to the change of the construction of a state information process, in order to deal with the plural MIDI channels in the state information process, step D is changed as follows.

D. On the decision in step C, in case that the state information transfer processing flag AFSTST is decided to be "1" indicating the state information is under the transfer. The state information transfer processing flag AFSTS is set as "0" indicating the end of transfer process.

Further, replace the state channel No. ASRCH indicating the MIDI channel No. being an object of state information process with the reopened state channel No. indicating the MIDI channel No. being an object of the state information process at the time of restarting the transfer and replace the state note No. ASRK with the reopened state note No. ASBK, so that next note No. of the previous transfer will be transferred at the time of restarting the transfer.

State Information Process Routine

In this embodiment, in corresponding to the change of the construction of state information, and in order to process plural MIDI channels consecutively and to process multiple note-on data in the state information process, in step G-1, note-on number of the MIDI channel No. and note No. corresponding to the state channel No. ASRCH and state note number ASRK is read out and the process of replacing the note-on number ANN with the read -out note-on number is added. In step G-9, a process of replacing the reopened state channel No. ASBCH with the state channel No. ASRCH is added. Further, in step G-10, in deciding whether the note-on flag AFK and velocity ARV is equal with the initial state or not, in addition to the conditions of the note-on flag AFK and velocity ARV, in case that the note-on number is "0," it is regarded as the equal data with the initial state is added. In addition to eliminating the step G-14 and step G-15, the step G-3 and step G-5 (step G-6) are changed as follows besides step G-16 is added between step G-11 and step G-13 and step G-17 to step 19 are being added.

G-3. On the decision in step G-2, in case that the state information transfer processing flag AFSTS is not "1", since it indicates that the state information transfer process is not under way, set the state information transfer processing flag AFSTS as "1" and execute the state information transfer start process by entering the "F4H" of the header message of state information in the Transfer FIFO.

G-5 (G-6). State Information Transfer Process I (II)

First enter the state data type byte wherein the upper four bits are set as "1H (OH)," indicating a note-on (note-off), the lower four bits, as the state channel No. ASRCH, the state note number ASRK, the velocity ARV and enter the state note-on number ANN sequentially, in the Transfer FIFO. Next, enter check sum data which is given by taking two's complement of the total of the state data type byte, state note No. ASRK, velocity ARV and note-on number ANN and by setting the bit 7 MSB as "0" in the Transfer FIFO. Further, the lower 7 bits of the total of check sum data obtained in the above-mentioned way, state data type byte, state note number ASRK, velocity ARV and note-on number ANN are "0". Finally, the Transfer FIFO empty flag AFSR is set as "0" indicating the Transfer FIFO or Real Time Transfer FIFO is not empty and give a demand to send to the transmitter circuit 24.

G-16. On the decision in step G-11, in case that the state note No. ASRK is decided to be not less than "127", since the process of a state information of this MIDI channel was finished, a decision is made as to whether the state channel No. ASRCH is less than "15" or not. In case of less than "15," go to the step step G-18, in case of not less than "15", go to the step G-13.

G-17. On the decision in step G-7, in case that the state note No. ASRK is decided to be not less than "127", since the process of a state information of this MIDI channel was finished, a decision is made as to whether the state channel No. ASRCH is less than 15 or not. In case of not less then "15", go to the step G-19.

G-18. On the decisions in step G-16 and step G-17, in case that the state channel No. ASRCH is decided to be less than "15," the process of a state information of the next MIDI channel is prepared as follows.

Set the state note No. ASRK and reopened state note No. ASBK as "0". Next, by adding "1" to the state channel No. ASRCH, replace a new state channel No. ASRCH and reopened state channel No. ASBCH with it. After the preparation for the process of a state information of the next MIDI channel is finished, return to the main routine.

G-19. In step G-13, in case that the process of state information transfer process III was finished or in case that the state channel No. ASRCH is decided to be not less than "15" in step G-17, since the state channel No. ASRCH is the final MIDI channel No. "15" and the note No. is the final note No. "127", set the state note No. ASRK and reopened state note No. ASBK as "0." Further, set the state channel No. ASRCH and reopened state channel No. ASBCH as "0," and return to the main routine.

Note-on/off Process Routine

In this embodiment, following process is added in step E-65.

A decision is made as to whether the note-on flag AFK is "1" and the velocity ARV is "0" or the note-on state AFK is "0", or not. In case that this note-on flag AFK is "1" and the velocity ARV is not "0," the number of note-on of the MIDI channel No. and note No. corresponding to the MIDI channel No. ARCH and note No. ARK in A-note map is increased by "1." In case that the note-on flag AFK is "1" and the velocity ARV is "0" or the note-on flag AFK is "0," a decision is made as to whether the number of note-on of the MIDI channel No. ARCH and note No. corresponding to the MIDI channel No. ARCH and note No. ARK in the A-note map is "0" or not. In case that this number of note-on is not "0", the number of note-on is decreased by "1" and in case of "0," the number of note-on remains as it is.

Channel Mode Process Routine

In this embodiment, in order to process the multiple note-on data, in the step E-74, a process of setting the number of note-on of MIDI channel No. and the note No. corresponding to MIDI channel No. ARCH and the note No. ARK in the A-note map as "0" is added.

On the side of Performance Information Receiving Device 30 Main Routine In this embodiment, in order to process a multiple note-on data, in step J, a process of initializing by setting the number of note-on on the all note-on No. of all MIDI channel No. in the B-note map as "0",and a process of initializing by setting the note-on flag as "1", the velocity as "0" and the number of as "0," on all the note No. of all MIDI channel No. in the C-note map, is added. Further, in corresponding to the change of construction of a state information process and the change of process of state renewal process, step K, step S, step U and Step V are changed as the follows:

K. A decision is made as to whether the Receiving FIFO defined in the B-RAM 33 is "empty" or not. In case of "empty," go to the step Y. As to the step Y, description is given later.

S. In case that the message code BRS is decided to be not "08H" or "71H", or the message code BRS is decided to be "00H" in step U, the temporary data BTEMP is temporarily accumulated in the stand-by buffer BBWT and a decision is made as to whether all byte of this MIDI message is received or not. In case of receiving all, each byte is read-out from the stand-by buffer BBWT sequentially and enter in the OUT FIFO and the B-MIDI circuit is enabled. In case of not receiving all, no special process is executed.

U. On the decision in step T, in case that the receive error flag BFER is decided to be "0", since it indicates that no transfer error is included in the MIDI message, a decision is made as to whether the message code. BRS is either "71H" "08H" "30H" or "00H". In case that this message code BRS is "71H," go to the next step V, in case of "0BH," go to step W and in case of "30H," go to step X. In case of "00H," since the temporary data BTEMP is the data byte of MIDI message which does not correspond to either state information, note-on, note-off or channel mode, return to step S.

V. A state information receiver process routine. In case that the message code BRS is "71H," since the temporary data BTEMP is the state information, a state information receive process is executed.

State Byte Receive Process Routine

In this embodiment, in step P-2, in corresponding to the change of construction of the state information and the change of process of state renewal process, a decision is made as to whether the stand-by buffer BBWT is "empty" or not. In case that this stand-by buffer BBWT is not "empty", enter each byte which is read out sequentially from the stand-by buffer BBWT in the OUT FIFO and enable the B-MIDI circuit 33. In case of "empty," a process of executing a special process is not added. In step P-8 and Step P-10, instead of the process of entering the temporary data BTEMP in the OUT FIFO and enabling the B-MIDI circuit 33 D, the process of accumulating temporarily the temporary data BTEMP in the stand-by buffer BBWT is executed. Also, step P-12 and step P-14 are eliminated and in case that the temporary data BTEMP is decided to be "F7H" in step P-1, go to step P-13. Further, step P-3, step P-11 and step P-13 are changed as follows:

P-3. A decision is made as to whether the temporary data BTEMP is the status "F4H" of state information. In case of "F4H," go to step P-11.

P-11. On the decision in step P-3, in case that the temporary data BTEMP is decided to be "F4H," set the message code BRS as "71H" indicating the header message of state information and set the data byte step BCLD indicating the decoding step of data byte of the temporary data BTEMP and the state data number BRNS as "0".

P-13. On the decision in step P-1 in case that temporary data BTEMP is decided to be "F7H," since it indicates the end of system exclusive message, accumulate the temporary data BTEMP in the stand-by buffer BBWT temporarily. And by reading out each byte sequentially from this stand-by buffer BBWT, enter them in the OUT FIFO and enable B-MIDI circuit 33D.

State Information Receive Process Routine

In this embodiment, in corresponding to the change of the construction of state information, step V-2 to V-11 are eliminated. Further, step V-12 to V-16 and step V-20 are changed as follows and step V-25 is added.

V-12. After the processing of step V-1, a decision is made as to whether the data byte BCLD is either "1" 37 2" "3" "4" or 5." In case of "1," go to the next step V-13, in case of "2," go to step V-17, in case of "3," go to to step V-18, in case of "4," go to step V-25 and in case of "5," go to step V-20.

V-13 to V-16. On the decision in step V-12, in case that the data byte BCLD is decided to be be "1", since the temporary data BTEMP is the type of state data, a decision is made as to whether the upper four bits of the temporary data BTEMP is "OH" indicating a note-off. In case of "OH", indicating a note-off, set the note-on flag AFK as "0." In case of not "0H", since it indicates a note-on, set the note-on flag BFK as "1" and replace the channel No. BRCH with the lower four bits of the temporary data BTEMP and replace the check sum calculation value BRSUM with the temporary data BTEMP and return to the main routine.

V-20. On the decision in step V-12, in case that the data byte BCLD is decided to be "5," since the temporary data BTEMP is the check sum data, add this temporary data BTEMP to the check sum calculation value BRSUM and make a new checksum calculation value BRSUM. In preparation for the next data process, set the data byte step BCLD as "0."

V-25. On the decision in step V-12, in case that the data byte BCLD is decided to be "4," since the temporary data BTEMP is the note-on number, replace the note-on number BNN with temporary data BTEMP and return to step V-19.

Note-on/off Receive Process Routine

Figure 23:
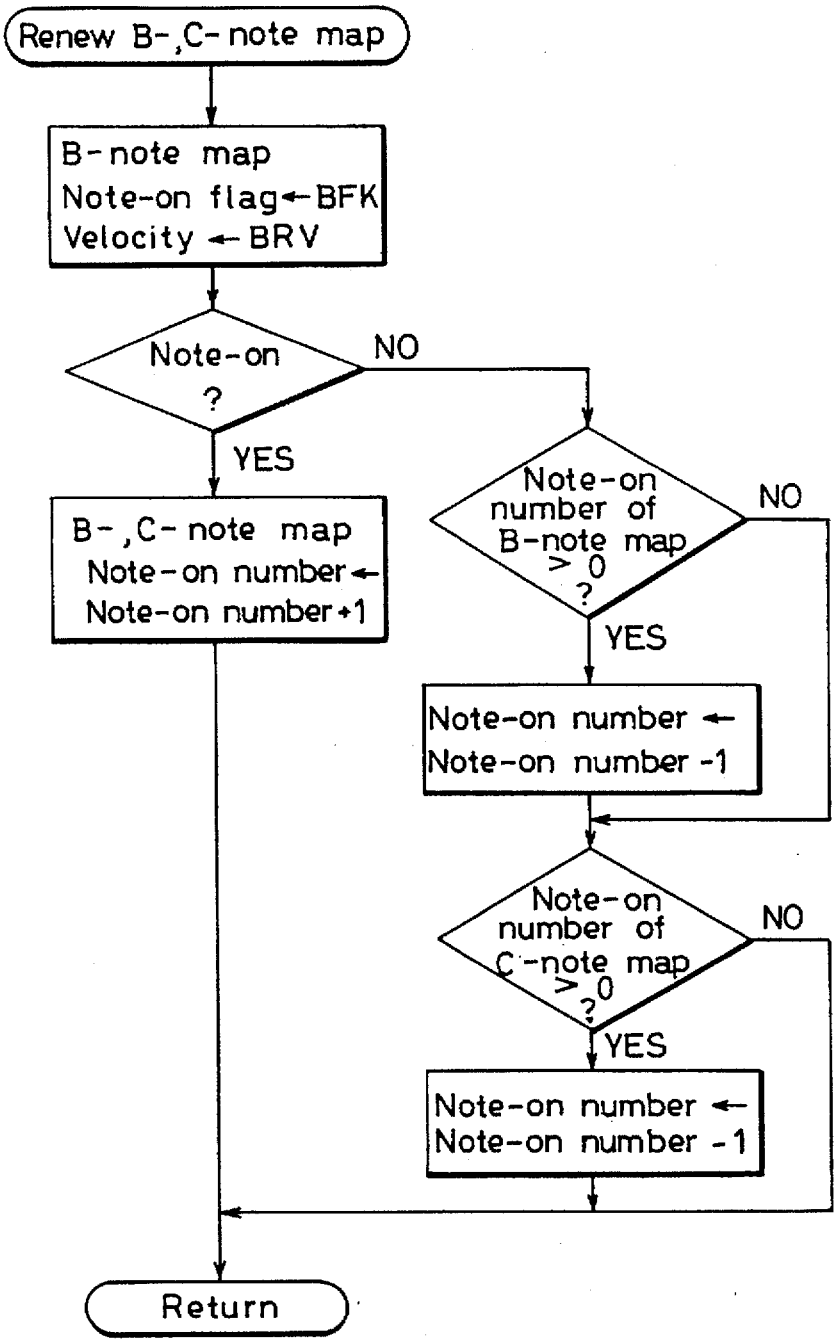
FIG. 23 and FIG. 24A, FIG. 24B are drawings for explaining a second embodiment of a performance information transmitter device and a performance information receiver device in a performance information transmission system and are flow-charts of a renewal routine of B- and C-note map and a state amendment routine.

In this embodiment, in order to process multiple note-on data, "B-note map renewal" step in the note-on/off receive process routine is changed to the B-, C- note map update process routine shown in FIG. 23.

Next, description is given on the B-, C-note map update process routine.

First, the note-on flag and velocity of the MIDI channel No. and note No. corresponding to the channel No. BRCH and note No. BRK in the B-note map are updated to the note-on flag BFK and velocity BRV. Next, a decision is made as to whether the note-on flag BFK is "1" and the velocity BRV is "0", or the note-on flag BFK is "0", or not. In case that the note-on flag BFK is "1" and the velocity BRV is not "0" the note-on number of MIDI channel No. and note No. corresponding to the channel No. BRCH and note number BRK in the B-note map and C-note map is increased by "1" and return to the note-on/off receive process routine.

And in case that note-on flag BFK is "1" and the velocity BRV is "0", or note-on flag BFK is "0", a decision is made as to whether the note-on number of MIDI channel No. and note No. corresponding to the channel No. BRCH and note number BRK in B-note map is more than "0", in case that this note-on number is more than "0," the note-on number is decreased by "1". Next, a decision is made as to whether the note-on number of MIDI channel No. and note No. corresponding to the channel No. BRCH and note No. BRK in the C-note map is more than "0" or not. In case of more than "0," the note-on number is decreased by "1" and return to the the note-on /off receiver process routine.

Channel Mode Receive Process Routine In this embodiment, in order to process multiple note-on data, a process of setting note-on number BNN as "0" in step X-3 and set the note-on number of MIDI channel No. and note No. corresponding to the channel No. BRCH and note No. BRK in the B-note map and C-note map as "0" in step X-5 are added.

State Update Process Routine

In this embodiment, in corresponding to the change of process of state renewal process, in step V-242, the process of setting note-on number temporary data BTNN as "0" is added, and in step V-245, the process of replacing the channel No. temporary value BTRCH with the channel No. BRCH and replacing the note-on number temporary value BTNN with the note-on number BNN are added And step V-243, step V-244, step V-246 and step V-247 are changed as follows:

V-243. First, a decision is made as to whether note No. temporary value BTRK is less than "127" or not. In case of less than "127," the note No. temporary value BTRK is increased by "1" and go to step V-244. In case of not less than "127," after setting the note No. temporary value BTRK as "0". A decision is made as to whether the channel No. temporary value BTRCH is less than "15" or not. In case of not less than "15," set the channel No. temporary value BTRCH as "0" and go to step V-244. In case of less than "15", the channel No. temporary value BTRCH is increased by "1," and go to step V-244.

V-244. A decision is made as to whether the channel No. temporary value BTRCH is the channel No. BRCH and the note No. temporary value BTRK is the note No. BRK or not. In case that the channel No. temporary value BTRCH is not the channel No. BRCH or the note No. temporary value BTRK is not the note note No. BRK, go to step V-247. In case that the channel No. temporary value BTRCH is the channel No. BRACH and the note No. temporary value BTRK is the note No. BRK, go to step V-245.

V-246, V-247. The note-on flag, velocity and note-on number of MIDI channel No. and the note No. corresponding to the channel No. temporary value BTRCH and note No. temporary value BTRK in C-note map are updated to the content of the note-on flag temporary value BTFK, velocity temporary value BTRV, note-on number temporary value BTNN. After the process of step V-246, return to the state information receive process routine and after the process of step V-247, return to step V-243.

Figure 24A:
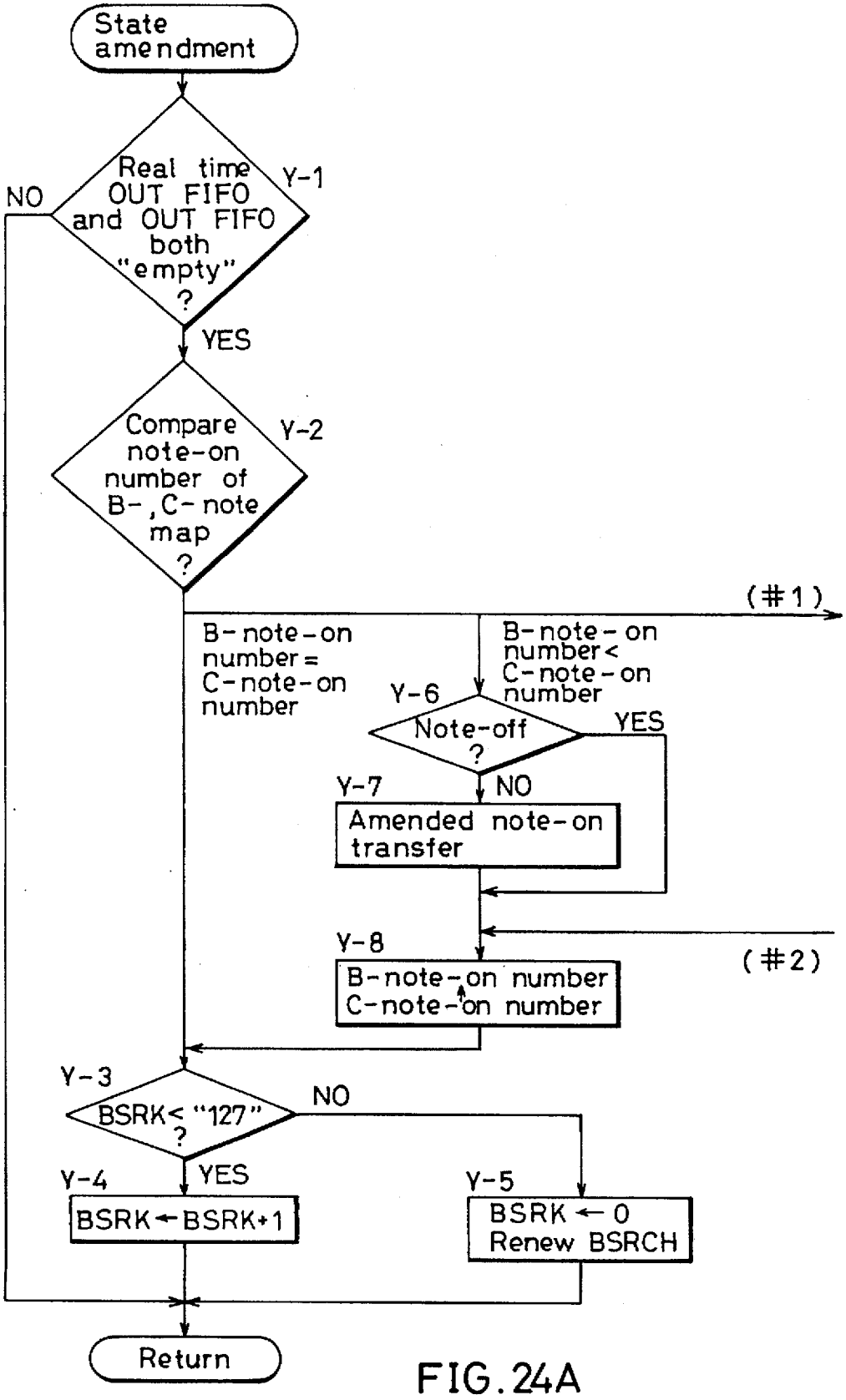
Figure 24B:
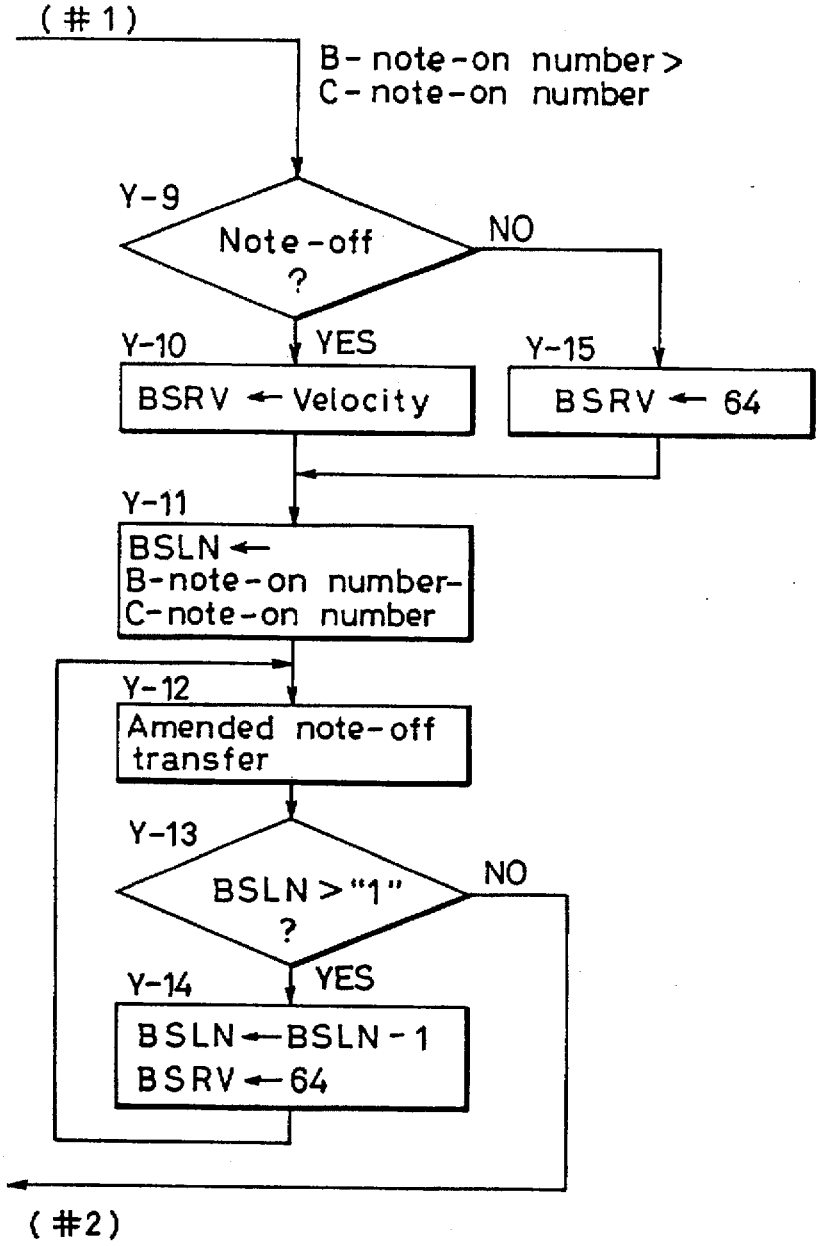

Next, in this embodiment, description is given on the state amendment (step Y) to be added for the change of process of state update process, referring to the FIG. 24.

Y-1. A decision is made as to whether the Real Time OUT FIFO and OUT FIFO are both "empty." In case of not "empty," return to step K.

Y-2. On the decision in step Y-1, in case that both of the real-time OUT FIFO and OUT FIFO are decided to be "empty," a comparison is made between the note-on number of MIDI channel No. and the note No. corresponding to the state amendment channel No. BSRCH and state amendment note No. BSRK in the B-note map and the note-on number of MIDI channel No. and the note No. corresponding to the state amendment channel No. BSRCH and state amendment note No. BSRK in the C-note map is made. In case that note-on number of B-note map and the note-on number of C-note map is same, go to the step Y-3, the note-on number of B-note map is less than the note-on number of C-note map, go to step Y-6, the note-on number of B-note map is more than note number of C-note map, go to step Y-9.

Y-3. On the decision in step Y-2, in case that the note-on number of B-note map and the note-on number of C-note map is same, a decision is made as to whether the state amendment note No. BSRK is less than "127" or not. In case of not less than "127," go to step Y-5.

Y-4. On the decision in step Y-3, in case that the state amendment note No. BSRK is less than "127," the state amendment note No. BSRK is increased by "1" and return to step K.

Y-5. On the decision in step Y-3, in case that the state amendment note No. BSRK is not less than "127," first set the state amendment note No. BSRK as "0." Next, in case that the state amendment channel No. BSRCH is less than "15," this state amendment channel No. BSRCH is increased by "1," and in case of not less than "15," the state amendment channel No. BSRCH is renewed by being set as "0" and return to step K.

Y-6. On the decision in step Y-2, in case that the note-on number of B-note map is decided to be less than the note-on number of C-note map, a decision is made as to whether the note-on flag of MIDI channel No. and the note No. corresponding to the state amendment channel No. BSRCH and state amendment note No. BSRK in the C-note map is "1" and the velocity of the MIDI channel No. and note No. is "0" or the note-on flag is "0" or not. In case that the note-on flag is "1" and velocity is "0" or the note-on flag is "0", go to step Y-8.

Y-7. On the decision in step Y-6, in case that the note-on flag is decided to be "1" and the velocity is "0," one byte wherein the upper four bits are set in "9H" and the lower four bits are set in channel No. BSRCH is entered in the OUT FIFO and state amendment note No. BSRK in the OUT FIFO. Next, the velocity of the MIDI channel No. and the note No. corresponding to the state amendment channel No. BSRCH and state amendment note No. BSRK in the C-note map is entered in the OUT FIFO and the B-MIDI circuit 33 D is enabled.

Y-8. The note-on number of MIDI channel No. and the note No. corresponding to the state amendment channel No. BSRCH and state amendment note No. BSRK in the B-note map is updated to the note-on number of MIDI channel No. and the note No. corresponding to the state amendment channel No. BSRCH and state amendment note No. BSRK in the C-note map.

Y-9. On the decision in step Y-2, in case that the note-on number of B-note map is decided to be more than the note-on number of C-note map, a decision is made as to whether the note-on flag of MIDI channel No. and the note number corresponding to the state amendment channel No. BSRCH and state amendment note No. BSRK in the C-note map is "1" and the velocity of the MIDI channel No. and note No. is "0", or the note-on flag is "0." In case that the note-on flag is "1" and velocity is not "0," go to step Y-15.

Y-10. On the decision in step Y-9, in case that the note-on flag is decided to be "1" and velocity is decided "0", or the note-on flag is "0", the state amendment velocity BSRV indicating the amendment velocity is replaced with the velocity of MIDI channel No. and the note number corresponding to the state amendment channel No. BSRCH and the state amendment note No. BSRK in the C-note map.

Y-11. The amendment note-off number BSLN indicating the note-off number which requires amendment is replaced with a value given by subtracting the note-on number of MIDI channel No. and the note No. corresponding to the state amendment channel No. BSRCH and state amendment note No. BSRK in the C-note map from the note-on number of MIDI channel No. and the note No. corresponding to the state amendment channel No. BSRCH and the state amendment channel No. BSRK in the B-note map.

Y-12. First, one byte wherein the upper four bits are set as "8H" and the lower four bits are set as the channel No. BSRCH entered in the OUT FIFO and next the state amendment note No. BSRK in the OUT FIFO. Next, to state amendment velocity BSRV is entered in the OUT FIFO and the B-MIDI circuit 33D is enabled.

Y-13. A decision is made as to whether the amendment note-off number BSLN is more than "1" or not. In case of not more than "1," return to step Y-8.

Y-14. On the decision in step Y-13, in case that the amendment note-off number BSLN is more than "1", the amendment note-off number BSLN is decreased by "1" and the state amendment velocity BSRV is set as "64," return to step Y-12.

Y-15. On the decision in step Y-9, in case that the note-on flag is decided to be "1" and velocity is not "0," set the state amendment velocity BSRV as "64."

In brief, in the state amendment routine (step Y), a comparison of note-on number is made between the B-note map and C-note map. In case of same number, it is regarded to be received normally. When the note-on number of C-note map is more than that of B-note map, the note-on data is regarded to be missing and when the note-on number of C-note map is less than that of B-note map, the note-off data is regarded to be missing. In both cases, amend the B-note map and transfer the amendment data. In transferring, in case that there is a corresponding data in the C-note map in transferring, transfer the data. In case that the note-on data is missing with no corresponding data, the amendment data is not transferred. And in case of losing the note-off, transfer the velocity making it a standard velocity.

Further, though in the first and second embodiments, the transmission between the performance information transmitter receiver device 20 and 30 is done by radio, it can be done by wire. In the transmission between the performance information transmitter receiver device 20 and 30, in order to secure the reliability, it is desirable not to use the running status. On the other hand, in the MIDI bus 21 and 34, it is desirable to use it properly, for the purpose of transmitting more data. Therefore, in the performance information transmitter device 20, it is desirable to add the status byte to the data given the running status process and in the performance information receiver device 30, it is desirable the running status process is given. In the first and second embodiment in order to eliminate the complicated description, the running status process was not given in the performance information receiver device 30.

In the first and second embodiments, the note-on flag and velocity are transmitted as the state information and if necessary, further information can be added. For example, in case that the connected sound generating unit generates a musical tone in which its tone and volume change with the course of time from key-on time such as the musical tone of percussive sounds, the data indicating the time passed from the key-on is also transmitted and from performance information receiver device 30, note-on amendment message wherein the velocity value which is amended based on the data indicating the time passed from key-on is transferred. Also, musical tone amendment message indicating the temporary change of the musical tone to be generated in the sound generating device based on the data passed from the key-on is also transferred. The content of processing is changed as follows: Set an area for storing the data indicating the time passed from the key-on corresponding to the each note No. in the A-note map in the performance information transmitter device 20. Next, clear the data based on the input of the note-on message of the corresponding note No. and increase it at a every predetermined time under the process of A-micro computer. Further, state data added with this data are transmitted. In the first embodiment, in transferring the note-on amendment message in the note-on/off amendment routine, the velocity value, which is amended based on the data indicating the time passed from the key-on, is transferred by the performance information receiver device 30. Also, musical tone amendment message indicating the temporary change of the musical tone to be generated at the sound generating device is transferred at the time of transmission note-on amendment message. In the second embodiment, set an area for storing the data indicating the time passed from the key-on corresponding to the each note No. in the C-note map of the performance information receiver device 30 and the data is replaced with the data indicating the time passed from the key-on included in the state data of corresponding note No. Next, increase the data at a predetermined time interval under the process of B-micro computer and when transferring the note-on amendment message, velocity value, which is amended based on the data, is transferred. Also, musical tone amendment message is transferred. The content of the amendment message is decided so that differences of the characteristics of the musical tone scheduled to be generated and the one to be generated actually by amendment message are minimized. Note-on amendment message is transferred for the purpose of restoring the missing note-on message which is transferred behind the originally scheduled timing. Accordingly, in a case that the connected sound generating device generates the musical tone of percussive sounds, the scheduled musical tone is decayed at the time of actual generation due to the note-on amendment message. In order to amend this, according to the characteristics of the musical tone to be generated by the sound generating device, for example, the velocity is changed to a small one in order to deal with the change of sound volume by decaying or MIDI channel No. is changed to the MIDI channel No. which is set in advance in order to generate corresponding musical tone in order to deal with the change of the musical tone. In this way, a better result is obtained than simply making the missing note-on message as amendment message. Further, the same can be said about the off-velocity. In the first and second embodiment, at the time of restarting the transfer of the state information after the process of state information transfer cancellation, the data corresponding to the note No. next to the previous transfer is arranged to be transferred, however, reopening process can be simplified by reopening the transfer from the data corresponding to the note No. which is not equal with the initial state and next to the data corresponding to the note No. of the previous transfer. Though all note No. of all channel No. are arranged to be transmitted, in case of being able to specify the range of use, only the state information within the corresponding range can be transmitted. The setting of range of use can be done by setting manually the operable member in the performance information transmitter device 20 or the change can be done by a receiving MIDI message. Further, by watching the MIDI channel for event information from the MIDI bus 21 in the performance information transmitter device 20, state information can be transmitted only to the channel which was inputted. Or if not necessary, the transmission of velocity of note-off or of velocity of note-on can be simplified by omitting it.

Though, in the first and second embodiment, description is given of the information process of the key-on/off in the event information. It is needless to say that same process can be applied to other event information. Also, as to the event information, afore-mentioned process can be executed. In transmission, the reliability can be improved by using other error detecting techniques or error correction techniques. Addition of parity bit is not necessary for simplification.

Further, the performance transmitter informaiton device 20 or performance information receiver device 30 can be integrated in the electric musical instrument. In the first and second embodiment, when the performance information receiver device 30 received an abnormal MIDI message, only in case that the MIDI message indicates either note-on or note-off, transfer to the MIDI bus 34 is canceled. However, in case of receiving abnormal MIDI message, it is acceptable not to transfer it regardless of the type of the message.

We claim:

1. A performance information transmitter device in a performance information transmission system, said transmitter device receiving MIDI formatted event information defining one or more musical tones by the events used to create them, comprising:

state information generating means, responsive to the received MIDI formatted event information, for generating state information defining the current state of one or more predetermined musical tones defined by the received MIDI formatted event information; and transmit means for sequentially transmitting said MIDI formatted event information and said state information generated by said state information generating means;

said state information being transmitted with said event information to redundantly define said musical tones to allow decoding of said event information in the absence of a portion thereof.

2. The performance information transmitter device as claimed in claim 1, further comprising:

a map memory;

said state information generating means executing the generation of state information of the one or more predetermined musical tones by updating state information for the predetermined musical tones, stored in said map memory, according to said event information.

3. The performance information transmitter device as claimed in claim 1, wherein said state information includes note-on data which indicates a current note-on.

4. The performance information transmitter device as claimed in claim 3, wherein said state information generating means generates said state information including said note-on information of one or more predetermined musical tones by updating said state information stored in said map memory according to said event information.

5. A performance information receiver device in a performance information transmission system, said transmitter device transmitting MIDI formatted event information defining one or more musical tones by the events used to create them and state information defining the current state of the one or more musical tones, said state information being transmitted with said event information to redundantly define said musical tones to allow decoding of said event information in the absence of a portion thereof, comprising:

receiving means for sequentially receiving said event information and state information; and event information correction means for correcting a transmission error in said event information received by said receiving means based on said state information received in a same manner.

6. The performance information receiver device as claimed in claim 5, further comprising:

a map memory;

said event information correction means correcting the transmission error in said event information for the predetermined musical tone by updating event information for the predetermined musical tone, stored in said map memory, according to said state information.

7. The performance information receiver device as set forth in claim 5 wherein said state information includes note-on data which indicates the number of a current note-on.

8. The performance information receiver device as claimed in claim 6, wherein said event information correction means corrects the transmission error of the event information for the predetermined musical tone by updating the event information for the predetermined musical tone stored in said map memory according to said state information including note-on information.

9. A performance information transmission system, said transmission system receiving MIDI formatted event information defining one or more musical tones by the events used to create them, comprising:

state information generating means, responsive to the received MIDI formatted event information, for generating state information defining the current state of one or more predetermined musical tones defined by the received MIDI formatted event information;

transmit means for transmitting sequentially said MIDI formatted event information and said state information generated by said state information generating means;

said state information being transmitted with said event information to redundantly define said musical tones to allow decoding of said event information in the absence of a portion thereof;

receiving means for sequentially receiving said event information and state information; and event information correction means for correcting a transmission error in said event information received by said receiving means based on said state information received in a same manner.

10. The performance information transmitter system of claim 9, wherein said state information generating means includes, a map memory;

said state information generating means executing the generation of state information of the one or more predetermined musical tones by updating state information for the predetermined musical tones, stored in said map memory, according to said event information.

11. The performance information transmitter system of claim 9, wherein said state information includes note-on data which indicates a current note-on.

12. The performance information transmitter system of claim. 11, wherein said state information generating means generates said state information including said note-on information of one or more predetermined musical tones by updating said state information stored in said map memory according to said event information.

* * * * *